US011920408B2

(12) United States Patent
Gan et al.

(10) Patent No.: US 11,920,408 B2
(45) Date of Patent: Mar. 5, 2024

(54) CUTTER WITH GEOMETRIC CUTTING EDGES

(71) Applicant: Schlumberger Technology Corporation, Sugar Land, TX (US)

(72) Inventors: Xiaoge Gan, Houston, TX (US); Youhe Zhang, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 161 days.

(21) Appl. No.: 17/770,508

(22) PCT Filed: Oct. 19, 2020

(86) PCT No.: PCT/US2020/056269
§ 371 (c)(1),
(2) Date: Apr. 20, 2022

(87) PCT Pub. No.: WO2021/080900
PCT Pub. Date: Apr. 29, 2021

(65) Prior Publication Data

US 2022/0381092 A1 Dec. 1, 2022

Related U.S. Application Data

(60) Provisional application No. 62/923,754, filed on Oct. 21, 2019.

(51) Int. Cl.
*E21B 10/567* (2006.01)

(52) U.S. Cl.
CPC ..... *E21B 10/5673* (2013.01)

(58) Field of Classification Search
CPC . E21B 10/5673; E21B 10/5671; E21B 10/567
See application file for complete search history.

(56) References Cited

U.S. PATENT DOCUMENTS 5,437,343 A * 8/1995 Cooley ..... E21B 10/567 175/434
7,726,420 B2 6/2010 Shen et al.
(Continued)

FOREIGN PATENT DOCUMENTS

CN 108661565 A 10/2018
WO 2018231343 A1 12/2018

OTHER PUBLICATIONS

International Preliminary Report on Patentability issued in International Patent application PCT/US2020/056269 dated May 5, 2022, 7 pages.

(Continued)

*Primary Examiner* — Shane Bomar
(74) *Attorney, Agent, or Firm* — Jeffrey D. Frantz

(57) ABSTRACT

A cutting element includes a base and a cutting face at opposite axial ends, a side surface extending between the base and the cutting face, an edge formed between the cutting face and the side surface, an edge chamfer having a uniform size around the entire edge, and a geometric shape formed on the cutting face and defined by a concave boundary with respect to a longitudinal axis of the cutting element. The concave boundary includes multiple rounded vertices, each rounded vertex located proximate to the edge chamfer and forming a cutting tip and multiple geometric shape sides connecting the rounded vertices, wherein the geometric shape sides are concave with respect to the longitudinal axis.

20 Claims, 17 Drawing Sheets

(56) References Cited

U.S. PATENT DOCUMENTS

| | | | | |
|---|---|---|---|---|
| 8,783,387 | B2 * | 7/2014 | Durairajan | E21B 10/5673 175/428 |
| 10,400,517 | B2 * | 9/2019 | Borge | E21B 10/46 |
| 10,577,870 | B2 * | 3/2020 | Izbinski | E21B 10/5735 |
| 2005/0247492 | A1 * | 11/2005 | Shen | E21B 10/5673 175/426 |
| 2013/0199856 | A1 * | 8/2013 | Bilen | E21B 10/5673 175/428 |
| 2014/0048339 | A1 | 2/2014 | DiGiovanni et al. | |
| 2015/0259988 | A1 | 9/2015 | Chen et al. | |
| 2016/0069140 | A1 * | 3/2016 | Patel | E21B 10/5673 175/430 |
| 2020/0157890 | A1 * | 5/2020 | Cuillier De Maindreville | E21B 10/5735 |
| 2020/0340303 | A1 * | 10/2020 | Cheng | E21B 10/42 |
| 2021/0002962 | A1 * | 1/2021 | Cheng | E21B 10/5673 |
| 2021/0215003 | A1 * | 7/2021 | Mahajan | E21B 10/5673 |

OTHER PUBLICATIONS

International Search Report and Written Opinion issued in International Patent application PCT/us2020/056269 dated Jan. 29, 2021, 11 pages.

* cited by examiner

| | DOC = 0.080" CONVEX vs FLAT PDC | DOC = 0.080" STRAIGHT vs FLAT PDC | DOC = 0.080" CONCAVE vs FLAT PDC |
|---|---|---|---|
| BR = 10 | -1% | -15% | -21% |
| BR = 20 | 0% | -16% | -19% |

| | TRI CONVEX vs Flat PDC | TRI STRAIGHT vs. FLAT PDC | TRI CONCAVE vs. FLAT PDC |
|---|---|---|---|
| DOC = 0.080" | 0% | -16% | -19% |
| DOC = 0.160" | 5% | -12% | -22% |

CUTTER WITH GEOMETRIC CUTTING EDGES

CROSS-REFERENCE TO RELATED APPLICATIONS

This application is a National Stage Entry of International Application No. PCT/US2020/056269, filed on Oct. 19, 2020, which claims the benefit of, and priority to, U.S. Patent Application No. 62/923,754 filed on Oct. 21, 2019, which is incorporated herein by this reference in its entirety.

BACKGROUND

Cutting elements used in down-hole drilling operations are often made with a super hard material layer to penetrate hard and abrasive earthen formations. For example, cutting elements may be mounted to drill bits (e.g., rotary drag bits), such as by brazing, for use in a drilling operation. FIG. 1 shows an example of a fixed cutter drill bit 10 (sometimes referred to as a drag bit) having a plurality of cutting elements 18 mounted thereto for drilling a formation. The drill bit 10 includes a bit body 12 having an externally threaded connection at one end 14, and a plurality of blades 16 extending from the other end of bit body 12 and forming the cutting surface of the bit 10. A plurality of cutters 18 are attached to each of the blades 16 and extend from the blades to cut through earth formations when the bit 10 is rotated during drilling. The cutters 18 may deform the earth formation by scraping and shearing.

Super hard material layers of a cutting element may be formed under high temperature and pressure conditions, usually in a press apparatus designed to create such conditions, cemented to a carbide substrate containing a metal binder or catalyst such as cobalt. For example, polycrystalline diamond (PCD) is a super hard material used in the manufacture of cutting elements, where PCD cutters typically comprise diamond material formed on a supporting substrate (typically a cemented tungsten carbide (WC) substrate) and bonded to the substrate under high temperature, high pressure (HTHP) conditions.

A PCD cutting element may be fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond grain layers are then compressed under HPHT conditions which promotes a sintering of the diamond grains to form a polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the super hard material layer or the substrate thereby reducing or eliminating the cutting elements efficacy and decreasing overall drill bit wear life.

SUMMARY

In one aspect, embodiments of the present disclosure relate to cutting elements that include a body with a base and a cutting face at opposite axial ends and a side surface extending between the base and the cutting face, an edge formed between the cutting face and the side surface, an edge chamfer having a uniform size around the entire edge, and a geometric shape formed on the cutting face and defined by a concave boundary with respect to a longitudinal axis of the cutting element. The concave boundary may include multiple rounded vertices, each rounded vertex located proximate to the edge chamfer and forming a cutting tip and multiple geometric shape sides connecting the rounded vertices, wherein the geometric shape sides are concave with respect to the longitudinal axis.

In another aspect, embodiments of the present disclosure relate to cutting elements having a body with a cylindrical side surface, a cutting face at an axial end of the body, and an edge formed between the side surface and the cutting face, a geometric shape formed on the cutting face and defined by a concave boundary with respect to a longitudinal axis of the cutting element, and multiple dual chamfer cutting tips formed on the cutting face at one or more vertices of the geometric shape, wherein each dual chamfer cutting tip includes two chamfers positioned axially adjacent to each other and between the geometric shape and the side surface.

In yet another aspect, embodiments of the present disclosure relate to cutting elements having a body with a side surface extending between a base and a cutting face at opposite axial ends of the body, an edge formed between the side surface and the cutting face, and a geometric shape formed on the cutting face, the geometric shape comprising multiple rounded vertices located adjacent to the edge, wherein the rounded vertices have a radius of curvature ranging from 0 percent to less than 50 percent of an outer diameter of the cutting element.

Other aspects and advantages of the invention will be apparent from the following description and the appended claims.

DETAILED DESCRIPTION

Embodiments of the present disclosure generally relate to cutting elements, which may be mounted to drill bits for drilling earthen formations or other cutting tools. Cutting elements disclosed herein may include a cutting face geometry designed to improve impact resistance and cutting efficiency. The cutting face geometry may include multiple cutting tips formed along the edge of the cutting element, wherein the cutting tip geometry reduces stress accumulation during operation, which may improve performance and the life of the cutting element. Cutting tips may be formed at the vertices of a geometric shape formed on the cutting face. In some embodiments, the vertices of the geometric shape may have a selected radius of curvature to provide the cutting tips with stress reducing geometry. In some embodiments, stress reducing geometry may be provided by a geometric shape formed on a cutting face having an entirely concave boundary with respect to a longitudinal axis of the cutting element, including concave sides extending between and connecting a plurality of concave vertices having a smaller radius of curvature than the concave sides.

Further, according to embodiments of the present disclosure, a cutting element may include a chamfer formed around the edge, or periphery, of the cutting face and encircling a geometric shape formed on the cutting face. In some embodiments, a second chamfer may be formed around the geometric shape. In embodiments having two chamfers, a first chamfer around the edge of the cutting face and a second chamfer around a geometric shape formed on the cutting face, the two chamfers may meet at one or more cutting tip locations along the edge of the cutting face, forming a dual chamfer cutting tip.

Figure 2:
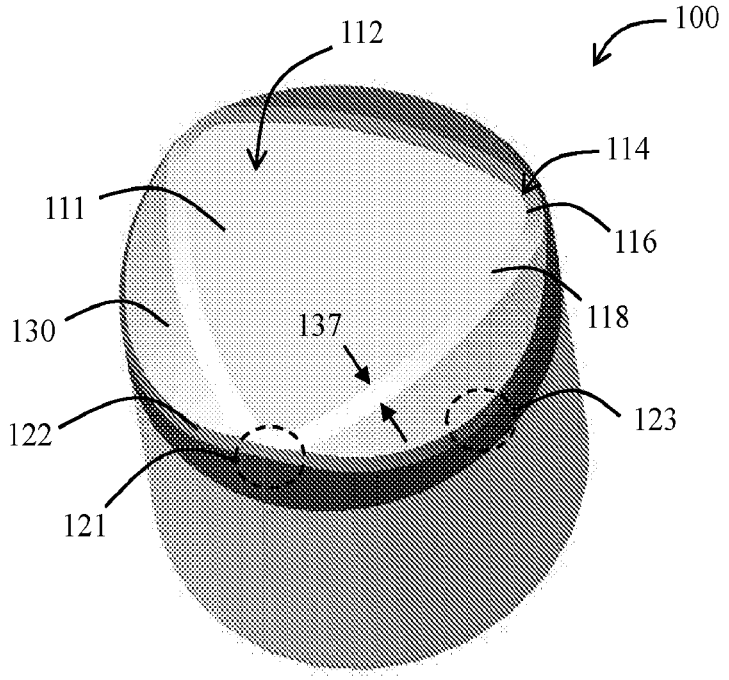
FIG. 2 shows a perspective view of a cutting element according to embodiments of the present disclosure.
Figure 3:
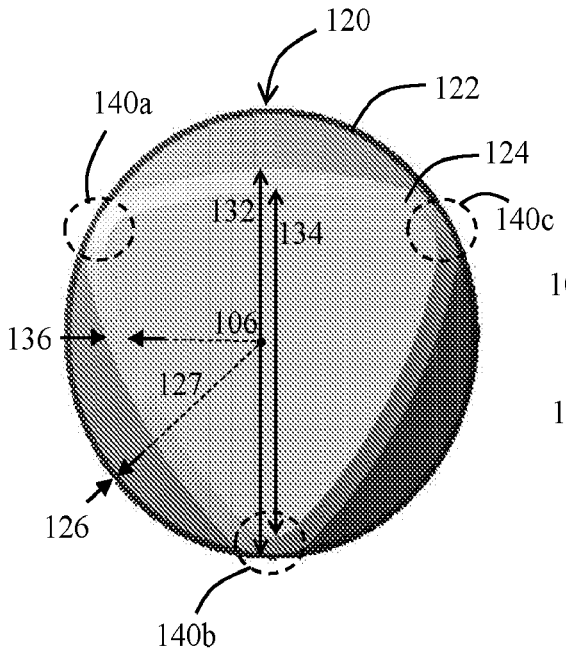
FIG. 3 shows a top view of the cutting element in FIG. 2.
Figure 4:
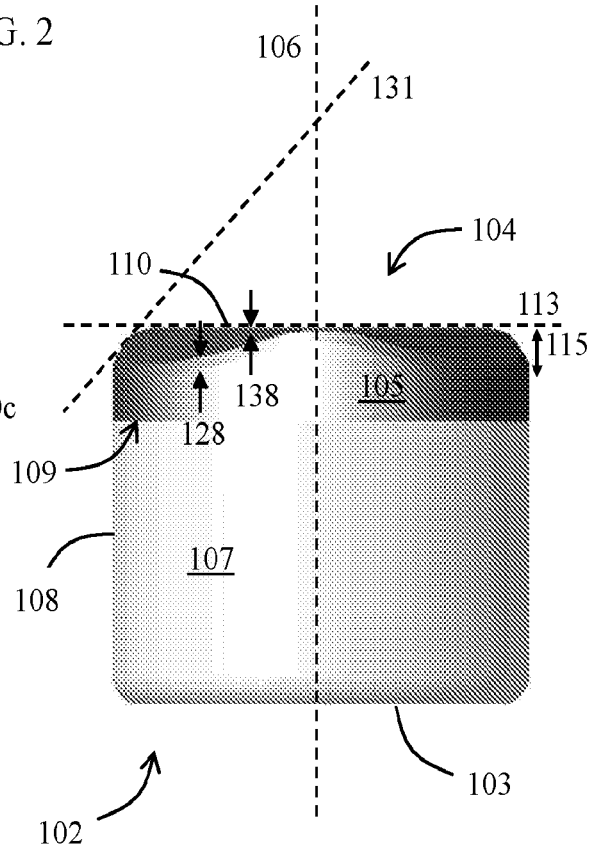
FIG. 4 shows a side view of the cutting element in FIGS. 2 and 3.

An example of a cutting element according to embodiments of the present disclosure is shown in FIGS. 2-4, where FIG. 2 shows a perspective view of the cutting element 100, FIG. 3 shows a top view of the cutting element 100 and FIG. 4 shows a side view of the cutting element 100. The cutting element 100 includes a base 102 and a cutting end 104 at opposite axial ends of the cutting element. In the embodiment shown, the base 102 includes a planar base surface 103 perpendicular to a longitudinal axis 106 of the cutting element. In other embodiments, a base may include a non-planar base surface (e.g., a curved surface or a base surface including one or more features for aiding in the connection of the cutting element to a cutting tool). A side surface 108 extends between the base 102 and the cutting end 104 and is generally parallel with the longitudinal axis 106. A cutting face 110 is formed at the cutting end 104 of the cutting element, opposite the base surface 103. The cutting element further includes an ultrahard material table 105 (e.g., a diamond table) disposed on a substrate 107, wherein the cutting face 110 is formed on the diamond table 105, and the substrate 107 forms the base 102.

The cutting face 110 has a geometry including a geometric shape 112 that is raised or protruding a relative axial height 115 from remaining portions of the cutting face 110, which in the embodiment shown, include the portions of the cutting face 110 near the periphery of the cutting face 110. The geometric shape 112 is defined by a boundary 114 including multiple rounded vertices 116 and multiple sides 118 extending between and connecting the rounded vertices. The entire boundary 114 may be concave with respect to the longitudinal axis 106, where both the rounded vertices 116 and the sides 118 are concave with respect to the longitudinal axis 106. The top surface 111 of the geometric shape 112, which also forms part of the cutting face 110, may be planar and extend generally along a plane 113 perpendicular to the longitudinal axis 106.

An edge 120 is formed at the intersection between the cutting face 110 and side surface 108 of the cutting element and extends circumferentially around the periphery of the cutting face 110. In the embodiment shown, the edge 120 is at varying axial heights from the base surface 103 (i.e., the edge 120 undulates), where the axially highest portions 121 of the edge 120 measured from the base surface 103 are adjacent the rounded vertices 116 of the geometric shape 112. The axially lowest portions 123 of the edge 120, as measured from the base surface 103, may be at midpoints along the edge 120 between axially highest portions 121 of the edge 120. The axial position of the edge 120 may also be described in relation to the top surface 111 of the geometric shape 112, where the axially highest portions 121 of the edge 120 are axially closer to the top surface 111 than the axially lowest portions 123 of the edge 120.

Further, an edge chamfer 122 is formed interior to and around the entire edge 120, where the intersection of the edge chamfer 122 and the side surface 108 form the edge 120. In some embodiments, a cutting face may have an edge chamfer formed partially around the edge (less than the entire edge) or may be without an edge chamfer around the edge (e.g., where the edge may be an angled intersection between the side surface of the cutting element and a sloped surface to a geometric shape top surface or shape chamfer). The edge chamfer 122 may have a uniform size around the entire edge 120, where the uniform size includes the chamfer 122 extending a uniform radial distance 126 measured along a radial dimension 127 from the side surface 108 and a uniform axial distance 128 measured along an axial dimension (parallel with the longitudinal axis 106) from the intersection of the chamfer 122 with the side surface 108.

In the embodiment shown, the cutting face 110 further includes a shape chamfer 124 formed around the entire boundary 114 of the geometric shape 112, where the boundary 114 is defined at the intersection of the inner length of the shape chamfer 124 and the top surface 111 of the geometric shape 112. In some embodiments, a shape chamfer may be formed around less than the entire boundary of a geometric shape formed on the cutting face, for example, partially around the boundary of a geometric shape or a cutting face may have a geometric shape formed thereon without a chamfer. In some embodiments, a shape chamfer may extend around one or more rounded vertices forming one or more chamfered cutting tips. Further, in some embodiments, a cutting face may have a geometric shape formed thereon with a shape chamfer partially around or entirely around the boundary of the geometric shape and no edge chamfer formed around the cutting element edge.

As shown in FIGS. 2-4, a shape chamfer 124 may have a uniform size around the entire boundary 114 of the geometric shape, where the uniform size includes the chamfer 124 extending a uniform shortest distance 137 between the two boundaries that define chamfer 124. Depending on, for example, the shape of the geometric shape and slope of the chamfer, a chamfer 124 may have a uniform or varied radial distance 136 measured along its radial dimension and may have a uniform or varied axial distance 138 measured along its axial dimension. Further, the shape chamfer 124 extends from an inner length 134 at the boundary 114 of the geometric shape 112 to an outer length 132. In some embodiments, a shape chamfer may vary in size around the boundary of a geometric shape (e.g., have varying axial distances and/or varying radial distances around the boundary of the geometric shape).

Multiple sloped surfaces 130 extend downwardly and radially outward in a direction from the boundary of the geometric shape 112 toward an edge 120 of the cutting element. The sloped surfaces 130 have a slope 131 with respect to the longitudinal axis 106 of the cutting element, where the slope 131 may vary or may be uniform around the circumferential position of the cutting face. In the embodiment shown, each of the sloped surfaces 130 extend from an intersection with the outer length 132 of the shape chamfer 124 to an intersection with the inner length of the edge chamfer 122, such that each sloped surface 130 is entirely bordered by the shape chamfer 124 and edge chamfer 122.

For clarity in defining and use of terms, an edge 120 of a cutting element 100 may refer to the intersection of a cutting element side surface 108 and the cutting face 110 and extends around the periphery of the cutting face 110. When an edge chamfer 122 is formed around the edge 120, the edge chamfer 122 may extend radially inward from the edge 120 and form part of the cutting face geometry. Thus, the features interior to the edge 120, including the geometric shape 112, shape chamfer 124, sloped surfaces 130, and edge chamfer 122, are considered to be part of the cutting face geometry. Further, as used herein, the top surface 111 refers to the portion of the cutting face 110 within the boundary 114 of the geometric shape 112. Thus, the cutting face 110 includes the top surface 111 as well as the surfaces of other features interior to the edge 120.

Each rounded vertex 116 of the geometric shape 112 formed on the cutting face 110 is positioned proximate to the edge chamfer 122 and forms a cutting tip 140*a*, 140*b*, 140*c* (collectively referred to as 140). In the embodiment shown, the portion of the shape chamfer 124 formed around the rounded vertices 116 intersect with the edge chamfer 122, such that the edge chamfer 122 and the shape chamfer 124 are adjacent to and in contact with each other at the cutting tips 140, thereby forming dual chamfer cutting tips 140.

Figure 1:
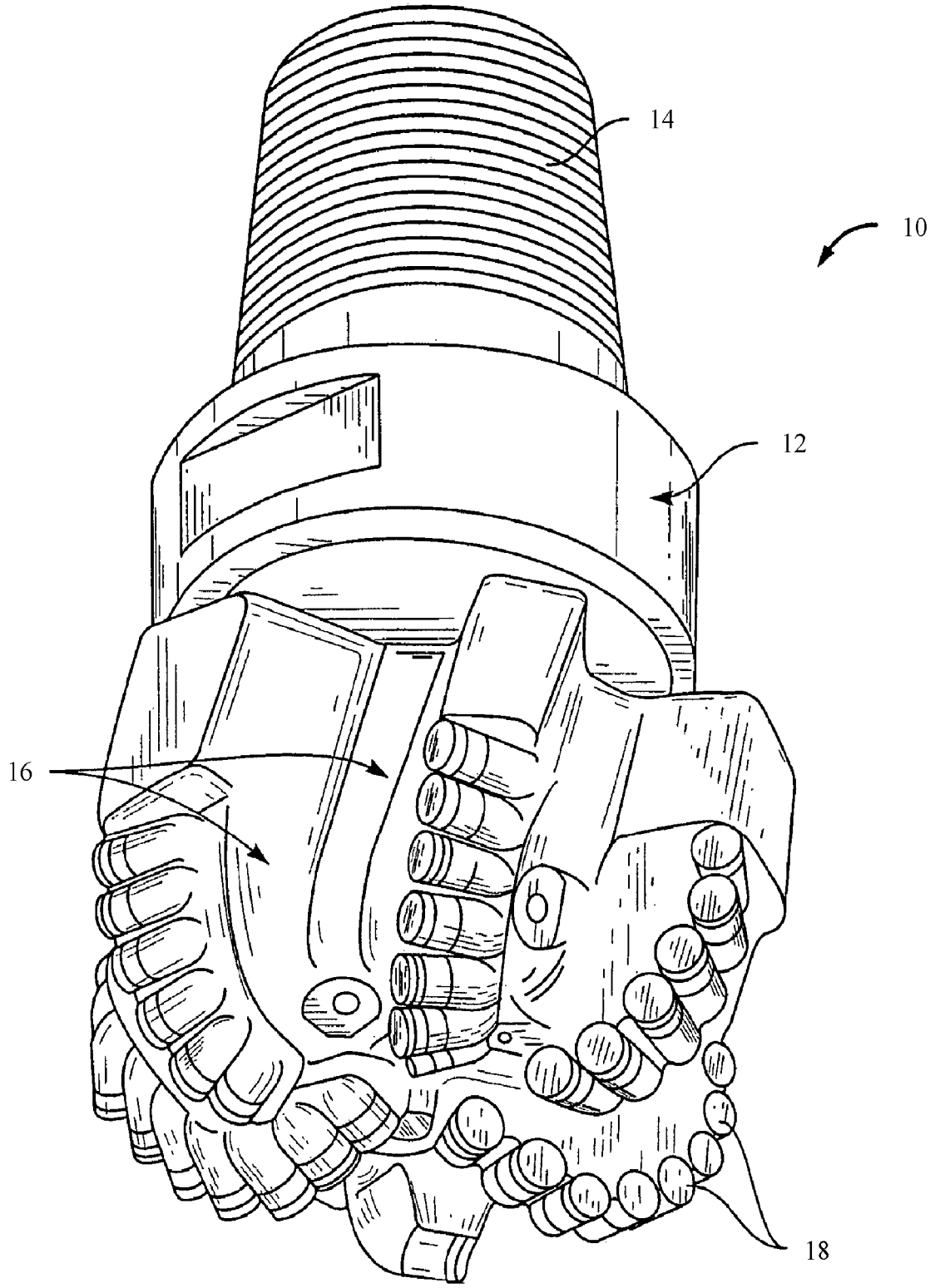
FIG. 1 shows a perspective view of a conventional fixed cutter drill bit.

The three rounded vertices 116 of the geometric shape 112 may form three dual chamfer cutting tips 140*a*, 140*b*, 140*c* evenly spaced around the edge 120 of the cutting element. By forming multiple dual chamfer cutting tips 140 around the edge 120 of the cutting element, the cutting element 100 may be rotated to three different rotational positions on a cutting tool to use each of the three dual chamfer cutting tips 140 to contact and cut into a formation. For example, the cutting element 100 may be positioned in a first rotational position on a cutting tool (such as cutting tool 10 shown in FIG. 1) such that a first dual chamfer cutting tip 140*a* may contact and cut into a formation during operation. When the first cutting tip 140*a* wears, the cutting element 100 may be removed and rotated to a second rotational position on the cutting tool such that a second cutting tip 140*b* may contact and cut into a formation during operation. When the second cutting tip 140*b* wears, the cutting element 100 may be removed and rotated to a third rotational position on the cutting tool such that a third cutting tip 140*c* may contact and cut into a formation during operation.

As shown best in FIG. 2, a dual chamfer cutting tip 140 may include a portion of the top surface 111 of the geometric shape and two chamfers 122, 124 positioned axially adjacent to each other and between the top surface 111 and the side surface 108. For example, the edge chamfer 122 may be adjacent the shape chamber 124 without the intermediate sloped surface 130 at the dual chamfer cutting tip 140. The two chamfers of a dual chamfer cutting tip 140 may provide a multifaceted geometry, where the dual chamfer cutting tip 140 has three adjacent surfaces (edge chamfer surface 122, shape chamfer surface 124, and top surface 111) intersecting with each other and axially stacked. In order from lowest axial position to highest axial position, the dual chamfer cutting tip 140 may include a portion of the edge chamfer 122 extending from the side surface 108 to the shape chamfer 124, a portion of the shape chamfer 124 extending from the edge chamfer 122 to the top surface 111, and a portion of the top surface 111. The portion of the top surface 111 considered to be part of a cutting tip 140 may be the portion of the top surface 111 within the area defined by a rounded vertex 116, which is best shown in FIG. 5, and described below.

Figure 5:
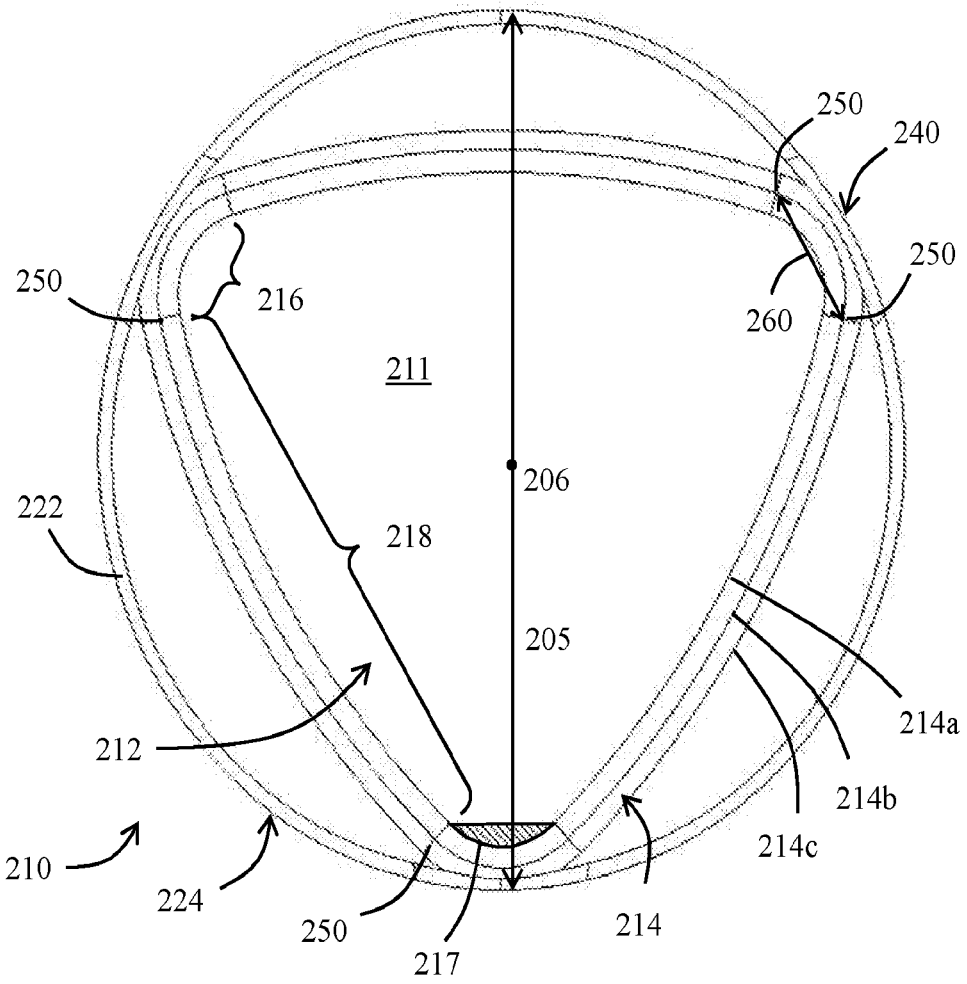
FIG. 5 shows a schematic of cutting face geometry according to embodiments of the present disclosure.

FIG. 5 shows a schematic of possible cutting face geometry, including boundaries and dimensions of rounded vertices 216 according to embodiments of the present disclosure. In the embodiment shown, the cutting face 210 has a geometric shape 212 defined by three potential boundaries 214*a*, 214*b*, 214*c* (indiscriminately referred to as 214), where 214*a* shows a relatively smaller boundary size, 214*c* shows a relatively larger boundary size, and 214*b* shows a potential boundary size in between 214*a* and 214*c*. The boundary 214 includes three rounded vertices 216 and three sides 218 alternatingly connected at transition points 250. A transition point 250 may be the point at which the radius of curvature changes from a substantially constant radius of curvature of a rounded vertex 216 to a different radius of curvature of an adjacent side 218. The rounded vertices 216 may be proximate to but spaced apart from an edge chamfer 222 formed around the periphery 224 of the cutting face, such as shown by potential boundary 214*a*, or rounded vertices 216 may be proximate to and intersecting with an edge chamfer 222, such as shown by potential boundary 214*c*.

The rounded vertices 216 of a geometric shape may form cutting tips 240 of the cutting element 200. A chord 260 of the cutting tip 240 may be measured between transition points 250 from the rounded vertex 216 to the adjacent sides 218 of the geometric shape. According to embodiments of the present disclosure, a chord 260 measured between the transition points 250 at the ends of a rounded vertex 216 may be less than 50 percent (e.g., less than 40 percent or less than 20 percent) of an outer diameter 205 of the cutting element. Further, a chord 260 measured between the transition points 250 at the ends of a rounded vertex 216 may be used to define the area of the top surface 211 of the geometric shape 212 that forms the cutting tip 240, which may be the area 217 of the geometric shape top surface within the chord 260 and rounded vertex 216 boundary.

According to embodiments of the present disclosure, a geometric shape 212 formed on a cutting element cutting face 210 may include one or more rounded vertices 216 having a radius of curvature ranging from a lower limit selected from 0.05 inches, 0.08 inches, 0.1 inches and 0.15 inches to an upper limit selected from 0.1 inches, 0.15 inches and 0.2 inches, where any lower limit may be used in combination with any upper limit. In some embodiments, a geometric shape 212 formed on a cutting element cutting face 210 may include one or more rounded vertices 216 having a radius of curvature ranging from 0% to less than 50% of the outer diameter 205 of the cutting element. The radius of curvature of a rounded vertex 216 may be selected, for example, based on the outer diameter 205 of the cutting element, the geometric shape (e.g., if the geometric shape is triangular or other polygonal shape), and the aggressiveness of cut desired.

The rounded vertices 216 and the sides 214 of a geometric shape 212 may be concave with respect to a longitudinal axis 206 of the cutting element. According to embodiments of the present disclosure, the sides 214 of a geometric shape 212 may have a radius of curvature ranging from a lower limit selected from 0.35 inches, 0.5 inches, 1 inch and 2 inches to an upper limit selected from 5 inches, 8 inches and 10 inches, where any lower limit may be used in combination with any upper limit. In some embodiments, a concave side 214 of a geometric shape 212 with respect to the longitudinal axis 206 may have a radius of curvature that is at least 50% of the outer diameter 205 of the cutting element. The radius of curvature of a geometric shape side 214 may be selected, for example, based on the outer diameter 205 of the cutting element and the number of rounded vertices 216 of the geometric shape (e.g., two, three, four or more rounded vertices).

Figure 6:
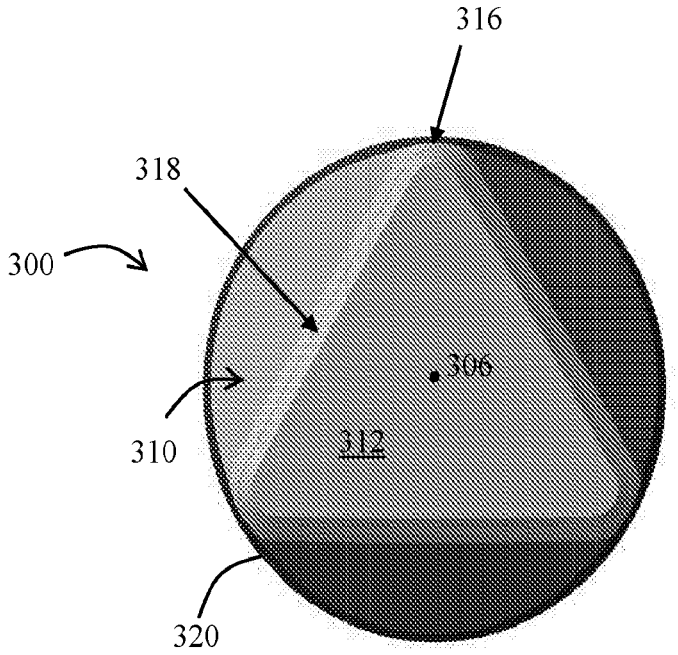
FIG. 6 shows a top view of a cutting element according to embodiments of the present disclosure.
Figure 7:
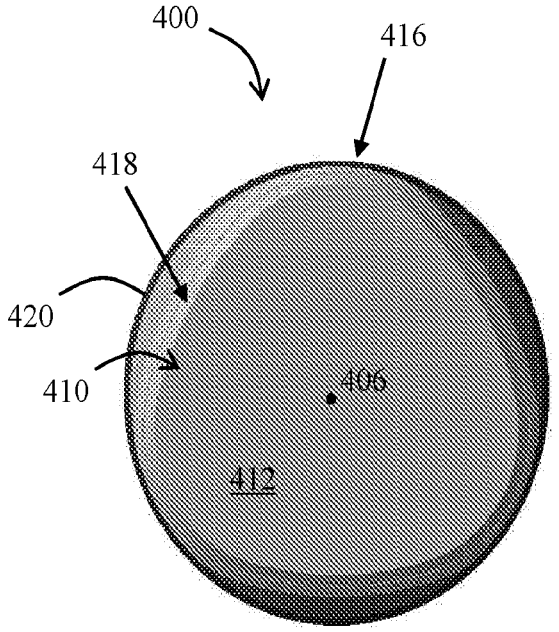
FIG. 7 shows a top view of a cutting element according to embodiments of the present disclosure.
Figure 8:
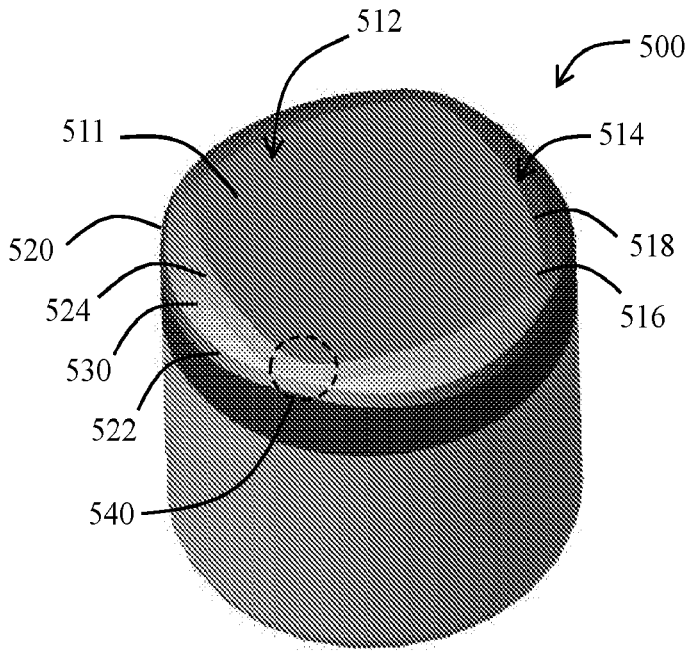
FIG. 8 shows a perspective view of a cutting element according to embodiments of the present disclosure.
Figure 9:
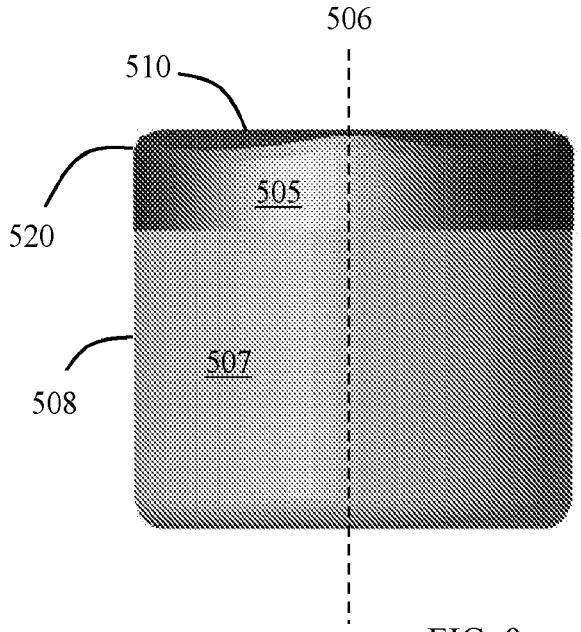
FIG. 9 shows a side view of the cutting element in FIG. 8.

FIGS. 6 and 7 show examples of cutting elements 300, 400 having different combinations of radii of curvatures for concave sides and rounded vertices of a geometric shape 312, 412 formed on a cutting face 310, 410. In FIG. 6, a geometric shape 312 may include three concave rounded vertices 316 spaced around the periphery of the cutting face 310 and three concave sides 318 extending between the vertices 316 to form a triangular geometric shape 312. The rounded vertices 316 have a relatively sharp radius of curvature, for example, about 0.05 inches, and the sides 318 have a relatively large radius of curvature that is almost straight, but concave with respect to the cutting element's longitudinal axis 306, for example, about 10 inches. In FIG. 7, the geometric shape 412 includes three rounded vertices 416 having a relatively blunt radius of curvature (compared to that in FIG. 6), for example, about 0.2 inches, and three sides 418 having a relatively small radius of curvature (compared to that in FIG. 6) that is concave with respect to the cutting element's longitudinal axis 406, for example, about 0.35 inches. According to embodiments of the present disclosure, a geometric shape may have rounded vertices with a radius of curvature ranging from the radius of the cutting element to 10 times the radius of the cutting element (e.g., 3 times, 5 times, or 8 times the radius of the cutting element).

Geometric shapes 312, 412 formed on a cutting face of a cutting element according to embodiments of the present disclosure may have a generally polygonal shape having rounded vertices 316, 416 and rounded sides 318, 418. The vertices 316, 416 and sides 318, 418 of a geometric shape 312, 412 may be concave with respect to the cutting element longitudinal axis 306, 406, such that the outline of the vertices and sides curve in a direction corresponding with the peripheral circular curvature of the edge 320, 420 of the cutting element 300, 400. Further, a geometric shape 312, 412 may be centered within the periphery of the cutting face 310, 410, where the central longitudinal axis 306, 406 of the cutting element coincides with a center point of the geometric shape 312, 412.

In the embodiments shown in FIGS. 2-7, a cutting element has a triangular geometric shaped formed on its cutting face, where the triangular geometric shape includes three rounded vertices and three concave sides with respect to the longitudinal axis of the cutting element. In some embodiments, a geometric shape may be a polygonal shape having more than three vertices and sides, for example, a polygonal shape having four or more rounded vertices.

For example, referring now to FIGS. 8-11, a cutting element 500 according to embodiments of the present disclosure is shown, where a geometric shape 512 having a boundary 514 with four rounded vertices 516 and four concave sides 518 is formed on the cutting face 510 of the cutting element. An edge 520 extends around the periphery of the cutting face 510 where the cutting face 510 meets the side surface 508 of the cutting element. The cutting face 510, edge 520, and a portion of the side surface 508 may be formed by an ultrahard material table 505, which may be mounted to a substrate 507.

The four rounded vertices 516 of the geometric shape 512 may form four cutting tips 540 evenly spaced around the edge 520 of the cutting element. By forming multiple cutting tips 540 around the edge 520 of the cutting element, the cutting element 500 may be rotated to four different rotational positions on a cutting tool to use each of the four cutting tips 540 to contact and cut into a formation. For example, the cutting element 500 may be positioned in a first rotational position on a cutting tool (such as cutting tool 10 shown in FIG. 1) such that a first cutting tip 540*a* may contact and cut into a formation during operation. When the first cutting tip 540*a* wears, the cutting element 500 may be removed and rotated to a second rotational position on the cutting tool such that a second cutting tip 540*b* may contact and cut into a formation during operation. When the second cutting tip 540*b* wears, the cutting element 500 may be removed and rotated to a third rotational position on the cutting tool such that a third cutting tip 540*c* may contact and cut into a formation during operation. When the third cutting tip 540*c* wears, the cutting element 500 may be removed and rotated to a fourth rotational position on the cutting tool such that a fourth cutting tip 540*d* may contact and cut into a formation during operation.

The geometric shapes shown in FIGS. 2-10 are regular polygonal shapes. However, in some embodiments, a geometric shape formed on a cutting face may have an irregular polygonal shape. For example, a geometric shape may have multiple vertices unevenly spaced around the periphery of a cutting face, such that multiple cutting tips formed by the vertices are unevenly spaced around the edge of the cutting element. In such embodiments, the geometric shape may also have multiple sides of different lengths. An irregular polygonal geometric shape formed on a cutting face may provide the cutting element with cutting tips having different radii of curvature (e.g., a vertex with a relatively smaller radius of curvature forming a relatively sharper cutting tip and a vertex with a relatively larger radius of curvature forming a relatively blunter cutting tip), which may have different aggressiveness in operation.

Figure 10:
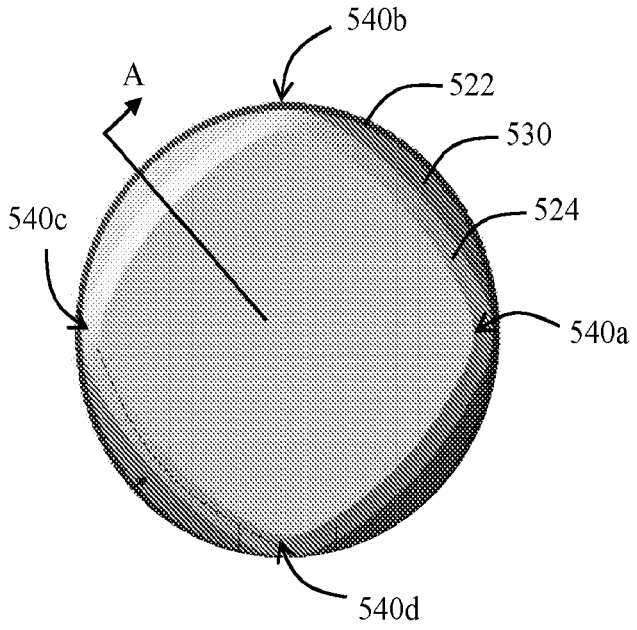
FIG. 10 shows a top view of the cutting element in FIGS. 8 and 9.
Figure 11:
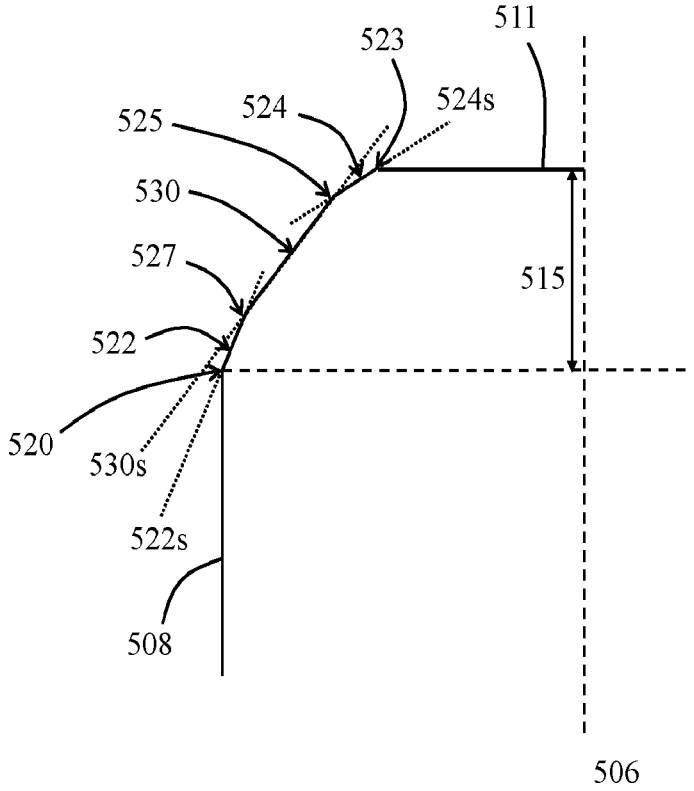
FIG. 11 shows a partial cross-sectional view of the cutting element in FIGS. 8-10.

Referring again to the cutting element 500 shown in FIGS. 8-11, the top surface 511 of the geometric shape 512 may be a planar surface perpendicular to the longitudinal axis 506 of the cutting element, forming a plateau raised an axial height 515 relative to the edge 520 of the cutting element. The top surface 511 of the geometric shape 512 forms a portion of the cutting face 510. Multiple discrete and intersecting surfaces may slope between the top surface 511 of the geometric shape 512 and the edge 520 of the cutting element, including an edge chamfer 522, sloped surfaces 530, and shape chamfer 524. FIG. 11 shows a partial axial cross-sectional view of the cutting element 500 along line A shown in FIG. 10 to more clearly show the discrete and intersecting surfaces along the axial profile of the cutting element 500 through a side 518 of the geometric shape 512. As shown, the shape chamfer 524 may slope downwardly and radially outward at slope 524*s* relative to the longitudinal axis 506 from an intersection 523 with the geometric shape top surface 511 to an intersection 525 with a sloped surface 530. The sloped surface 530 may slope downwardly and radially outward at slope 530*s* relative to the longitudinal axis 506 from the intersection 525 with the shape chamfer 524 to an intersection 527 with the edge chamfer 522. The edge chamfer 522 may slope downwardly and radially outward at slope 522*s* relative to the longitudinal axis 506 from the intersection 527 with the sloped surface 530 to the edge 520. Each of the shape chamfer 524, sloped surface 530, and edge chamfer 522 may have different slopes 524*s*, 530*s*, 522*s*.

At locations along the vertices 516 of the geometric shape 512, the shape chamfer 524 may intersect with the edge chamfer 522, such that the shape chamfer 524 slopes axially and radially outward at slope 524*s* relative to the longitudinal axis 506 from the top surface 511 of the geometric shape to the edge chamfer 522, and the edge chamfer 522 slopes axially and radially outward at slope 522*s* relative to the longitudinal axis 506 from the shape chamfer 524 to the edge 520, and where the shape chamfer 524 and edge chamfer 522 have different slopes.

Further, the shape chamfer 524, the sloped surfaces 530 and the edge chamfer 522 may have substantially planar cross-sectional profiles along their slopes when viewed along an axial cross-sectional plane intersecting the length of the longitudinal axis, such as shown in FIG. 11, but may have substantially concave radial cross-sectional profiles when viewed along a radial cross-sectional plane bisecting the longitudinal axis (e.g., such as shown in the top view of FIG. 10). In some embodiments, the shape chamfer 524, the sloped surfaces 530 and the edge chamfer 522 may have substantially planar cross-sectional profiles along their slopes 524*s*, 530*s*, 522*s* when viewed along an axial cross-sectional plane intersecting the length of the longitudinal axis (as shown in FIG. 11), the shape and edge chamfers 524, 522 may have substantially concave radial cross-sectional profiles when viewed along a radial cross-sectional plane bisecting the longitudinal axis, and the sloped surfaces 530 may have substantially planar radial cross-sectional profiles when viewed along a radial cross-sectional plane bisecting the longitudinal axis.

Figure 12:
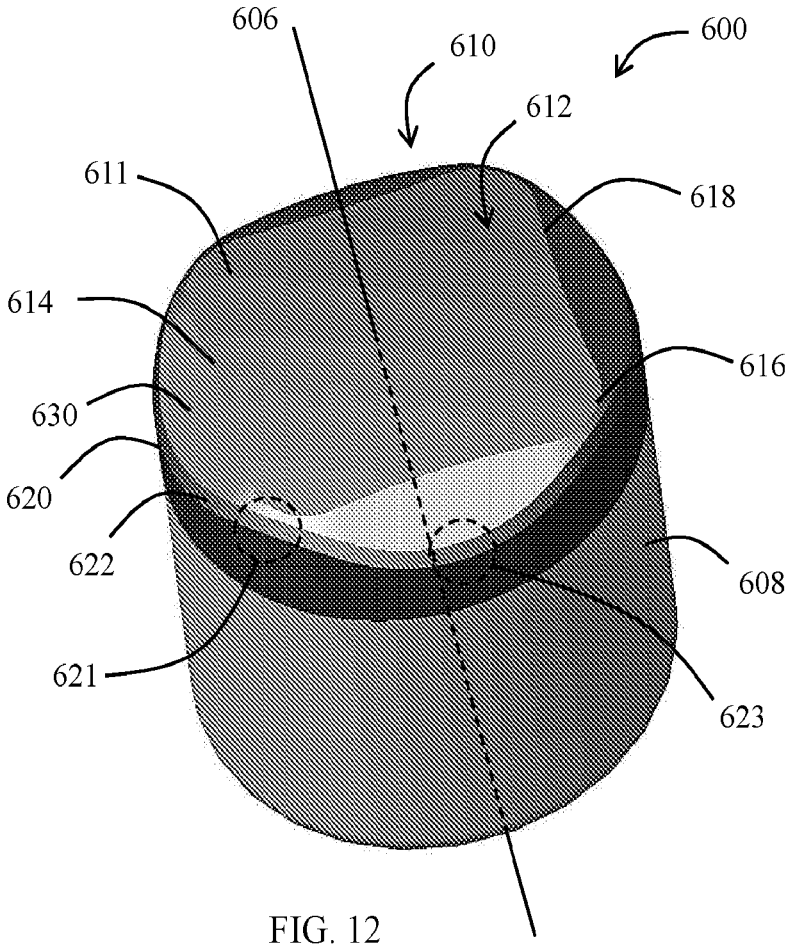
FIG. 12 shows a perspective view of a cutting element according to embodiments of the present disclosure.

In some embodiments, a geometric shape may be formed on a cutting face without a shape chamfer formed around its boundary, such as shown in the embodiment of FIG. 12. As shown in FIG. 12, a cutting element 600 includes a cutting face 610 formed at a cutting end of the cutting element 600, a side surface 608 extending circumferentially around the cutting element 600, and an edge 620 formed at the intersection of the cutting face 610 and side surface 608. The cutting face 610 includes a geometric shape 612 having a top surface 611 raised an axial height relative to the edge 620 of the cutting element. Sloping axially and radially outward from the top surface 611 of the geometric shape are sloped surfaces 630, where the sloped surfaces 630 intersect with the top surface 611 along the entire boundary 614 of the geometric shape 612. The boundary 614 of the geometric shape includes four equal and straight sides 618 and four concave vertices 616, forming a substantially square geometric shape 612. The cutting face 610 further includes an edge chamfer 622 formed around the periphery of the cutting face 610, where the edge chamfer 622 slopes axially and radially outward from an intersection with the sloped surfaces 630 to the edge 620 of the cutting element 600.

The edge 620 of the cutting element extends around the periphery of the cutting face 610 at different axial positions along the longitudinal axis 606 of the cutting element. In the embodiment shown, the axially highest portions 621 of the edge 620 are located circumferentially around the periphery of the cutting face 610 adjacent to the vertices 616. The axially lowest portions 623 of the edge 620 are at circumferential locations around the periphery of the cutting face 610 that align with the midpoints of the sides 614, which are also midpoints between the axially highest portions 621 of the edge 620. The edge 620 undulates between the axially highest portions 621 and axially lowest portions 623 around the periphery of the cutting face 610. The top surface 611 of the geometric shape 612 is planar and extends along a plane perpendicular to the longitudinal axis of the cutting element. The undulating axial positions of the edge 620 varies with respect to the axial position of the top surface 611, where the axial distance between the top surface 611 of the geometric shape and the edge 620 of the cutting element varies around the periphery of the cutting face 610.

Each of the surfaces forming the geometry of the cutting face may be planar or curved or a combination of planar and curved. For example, as described below, a top surface of a geometric shape may be convex with respect to a plane perpendicular to the cutting element longitudinal axis, such as shown in FIGS. 13A and 13B, a top surface may be planar and extend along a plane perpendicular to the cutting element longitudinal axis, such as shown in FIGS. 14A and 14B, or a top surface may be concave with respect to a plane perpendicular to the cutting element longitudinal axis, such as shown in FIGS. 15A and 15B.

Figure 13A:
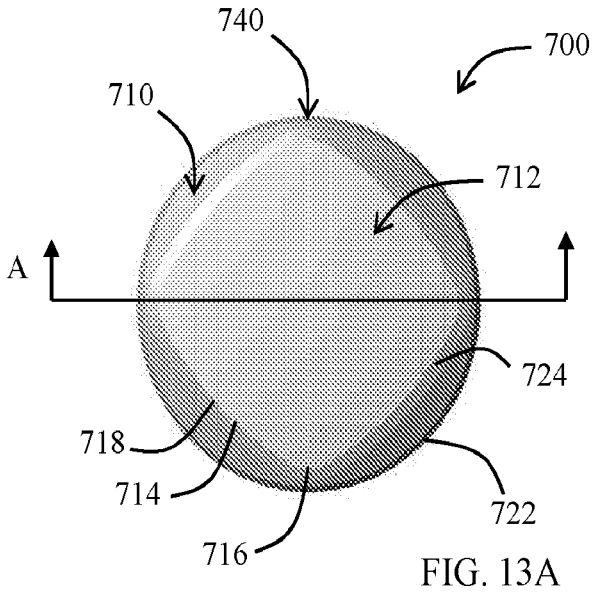
FIGS. 13A and 13B show a top view and cross-sectional view, respectively, of a cutting element according to embodiments of the present disclosure.
Figure 13B:
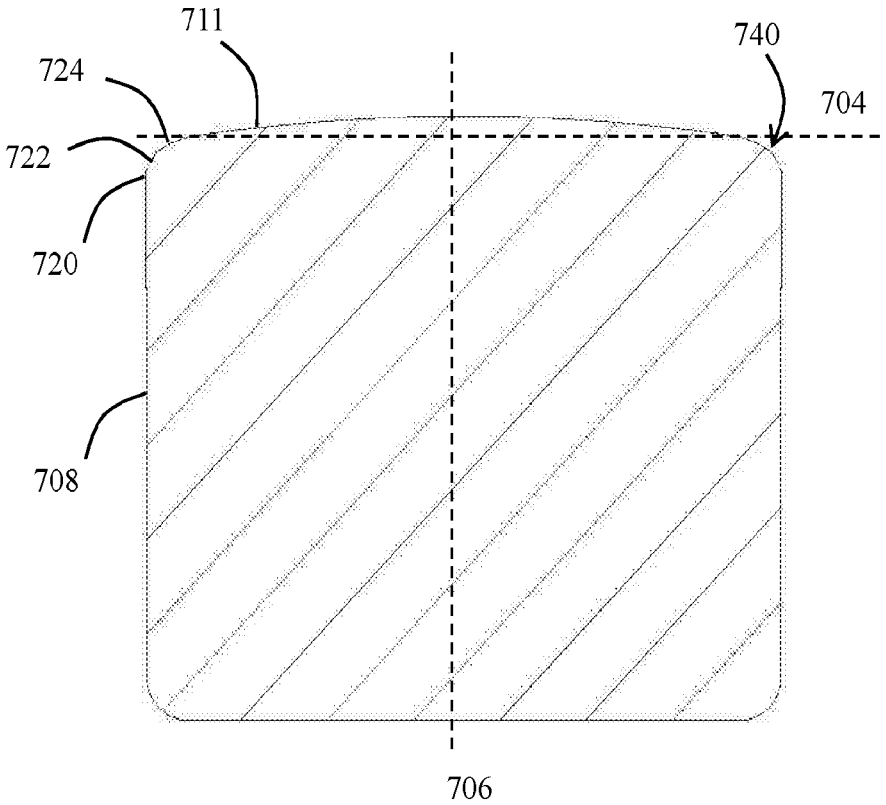

FIG. 13A shows a top view of a cutting element 700 according to embodiments of the present disclosure, and FIG. 13B shows an axial cross-sectional view along plane A of the cutting element 700. The cutting element 700 includes a geometric shape 712 formed at the cutting element cutting face 710, where the top surface 711 of the geometric shape 712 is convex with respect to a plane 704 perpendicular to the longitudinal axis 706 of the cutting element. The geometric shape 712 has a boundary 714 made of sides 718 and vertices 716 that are concave with respect to the longitudinal axis 706. As shown in the cross-sectional view of the cutting element 700 in FIG. 13B, at circumferential positions around the cutting face 710 aligning with the cutting element cutting tips 740, a shape chamfer 724 formed around the boundary 714 of the geometric shape 712 extends axially and radially outward from an angled intersection with the top surface 711 to an angled intersection with an edge chamfer 722, and the edge chamfer 722 may slope axially and radially outward from the intersection with the shape chamfer 724 to the edge 720 of the cutting element, where the edge 720 is formed at the intersection between the cutting face 710 and the side surface 708 of the cutting element. Further, the edge chamfer 722 may extend around the periphery of the cutting face 710, entirely surrounding the shape chamfer 724.

Figure 14A:
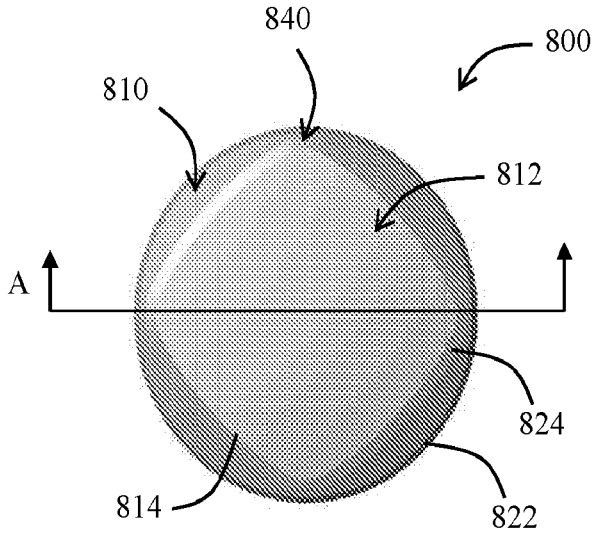
FIGS. 14A and 14B show a top view and cross-sectional view, respectively, of a cutting element according to embodiments of the present disclosure.
Figure 14B:
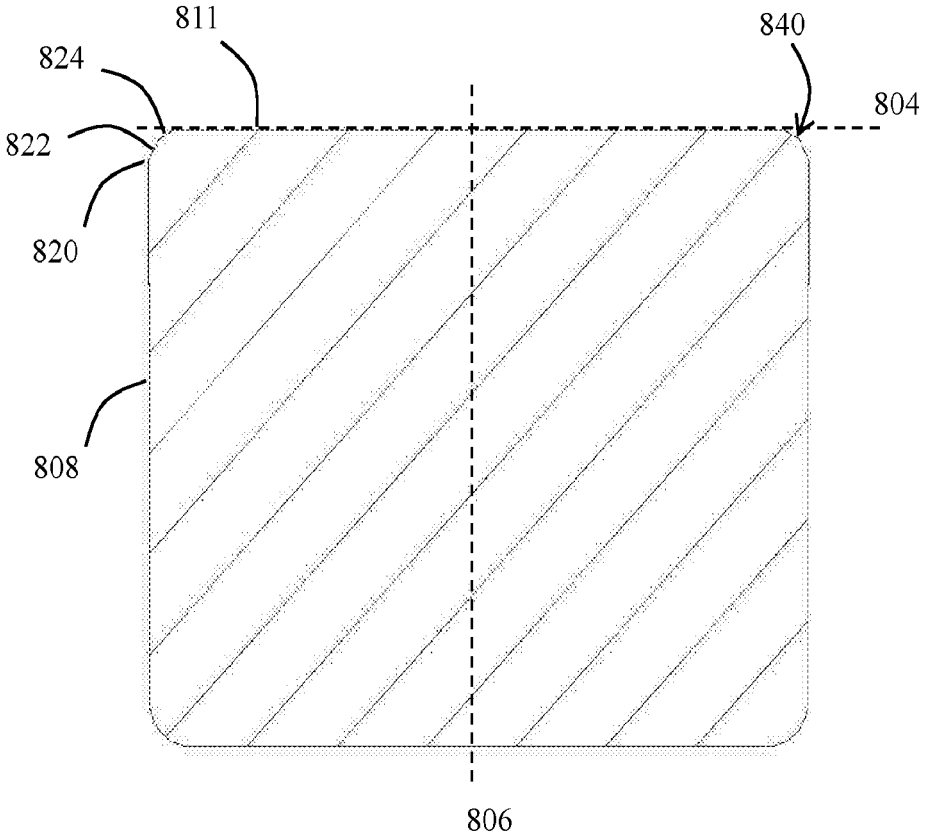

FIG. 14A shows a top view of a cutting element 800 according to embodiments of the present disclosure, and FIG. 14B shows an axial cross-sectional view along plane A of the cutting element 800. The cutting element 800 includes a geometric shape 812 formed at the cutting element cutting face 810, where the top surface 811 of the geometric shape 812 is planar and extends along a plane 804 perpendicular to the longitudinal axis 806 of the cutting element. The geometric shape 812 may have a shape chamfer 824 formed around the boundary 814 of the geometric shape 812. At circumferential positions around the cutting face 810 corresponding with the cutting element cutting tips 840, the shape chamfer 824 extends axially and radially outward from an angled intersection with the top surface 811 to an angled intersection with an edge chamfer 822, and the edge chamfer 822 may slope axially and radially outward from the intersection with the shape chamfer 824 to the edge 820 of the cutting element, where the edge 820 is formed at the intersection between the cutting face 810 and the side surface 808 of the cutting element.

Figure 15A:
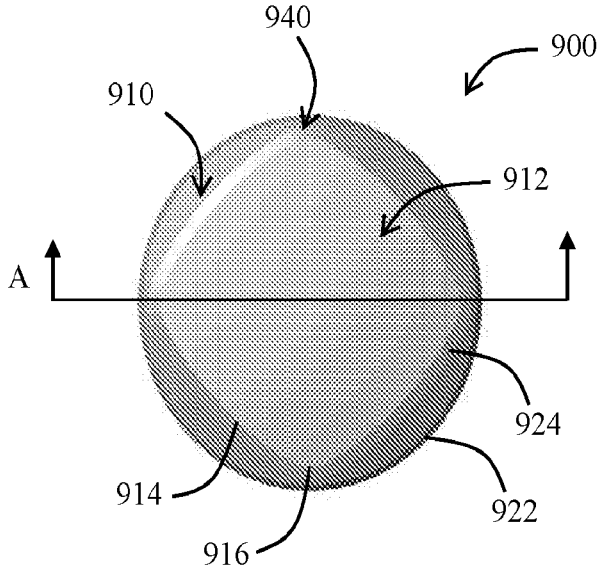
FIGS. 15A and 15B show a top view and cross-sectional view, respectively, of a cutting element according to embodiments of the present disclosure.
Figure 15B:
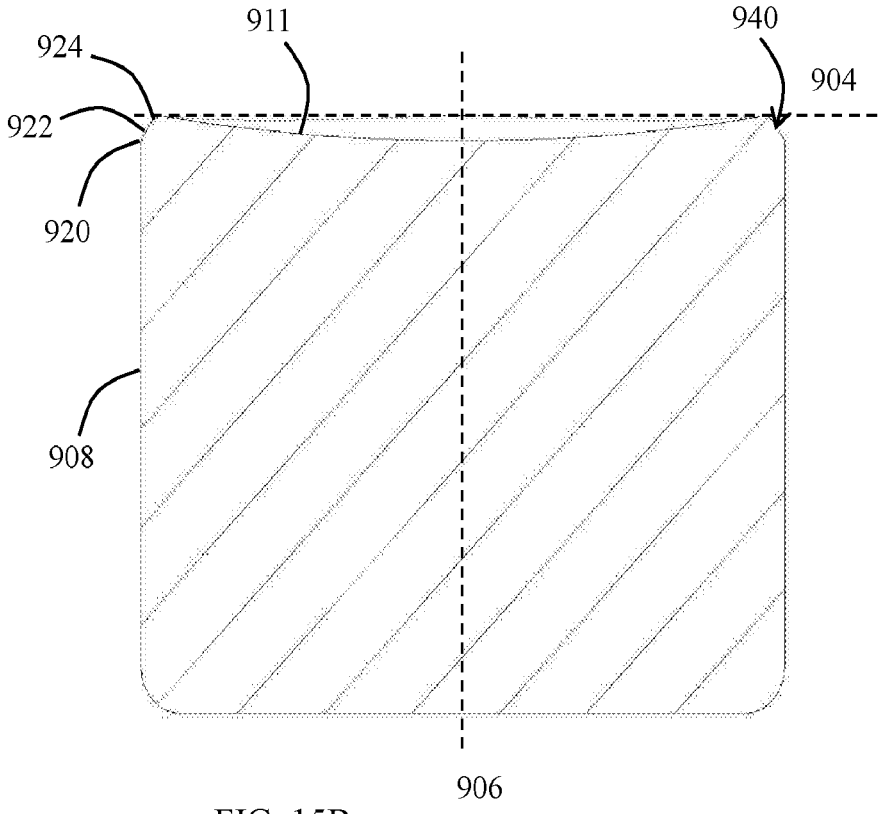
Figure 16A:
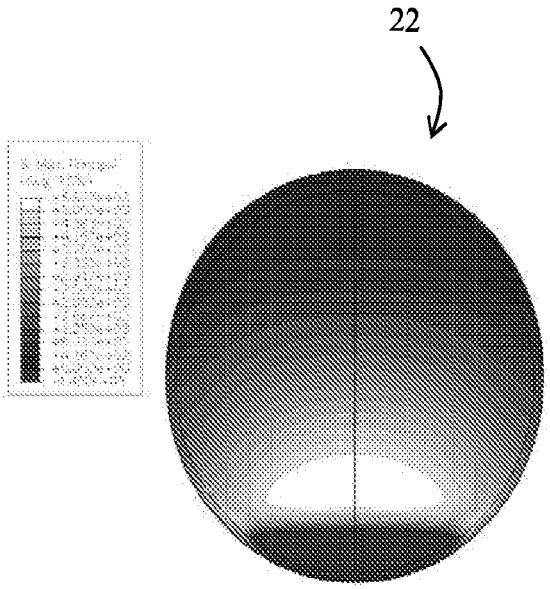
FIGS. 16A-16D show finite element analysis comparing stress accumulation in a cutting element according to embodiments of the present disclosure (FIG. 16D) to stress accumulation in comparison cutting elements (FIGS. 16A-C) under same conditions.
Figure 16B:
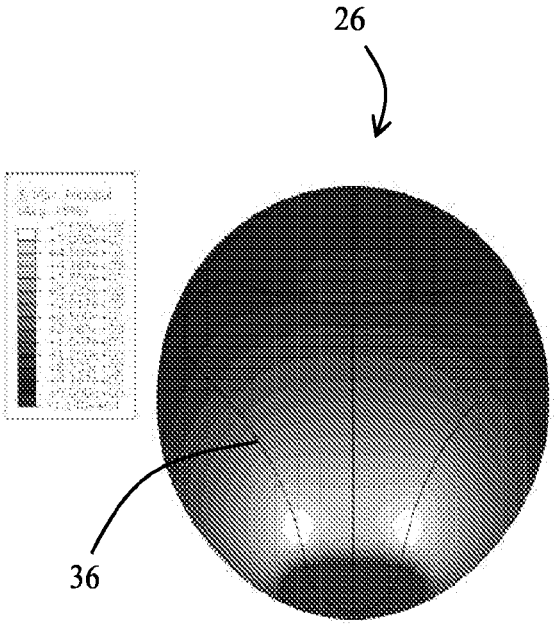
Figure 16C:
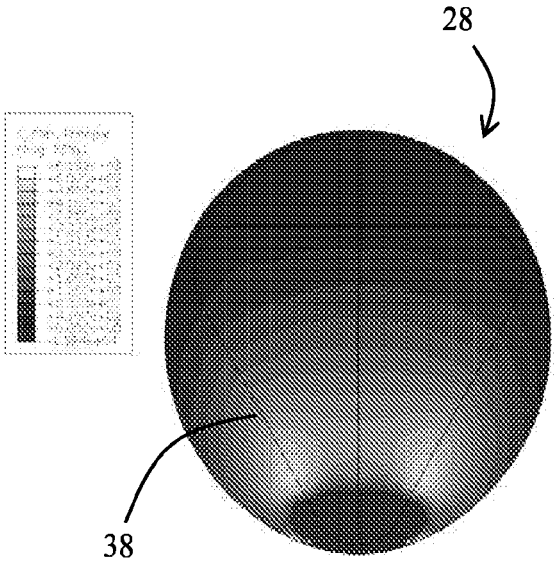
Figure 16D:
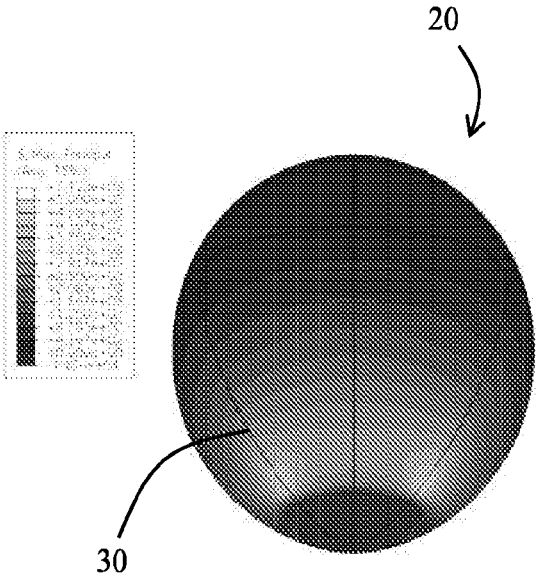
Figure 17A:
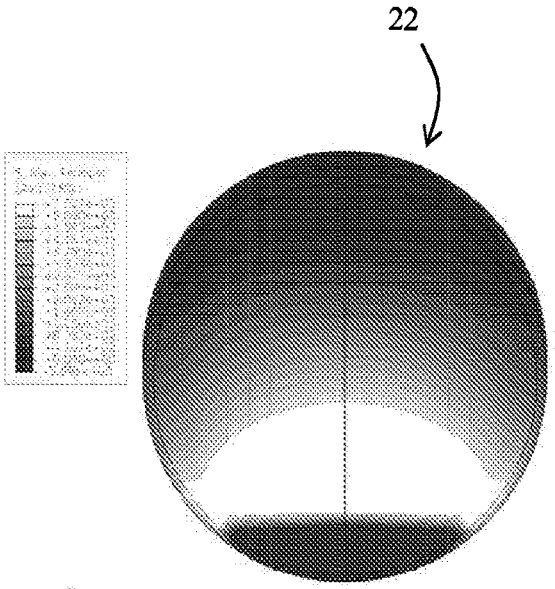
FIGS. 17A-17D show finite element analysis comparing stress accumulation in a cutting element according to embodiments of the present disclosure (FIG. 17D) to stress accumulation in comparison cutting elements (FIGS. 17A-C) under same conditions.
Figure 17B:
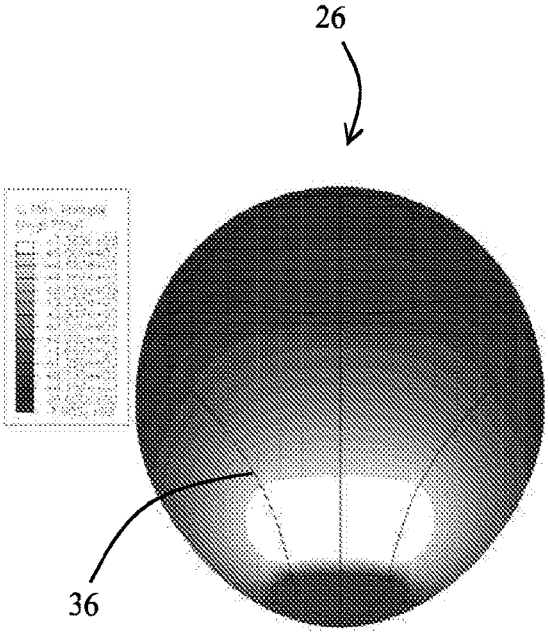
Figure 17C:
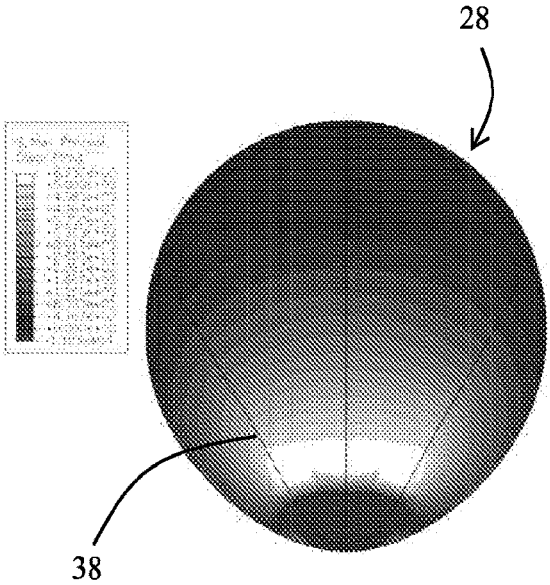
Figure 17D:
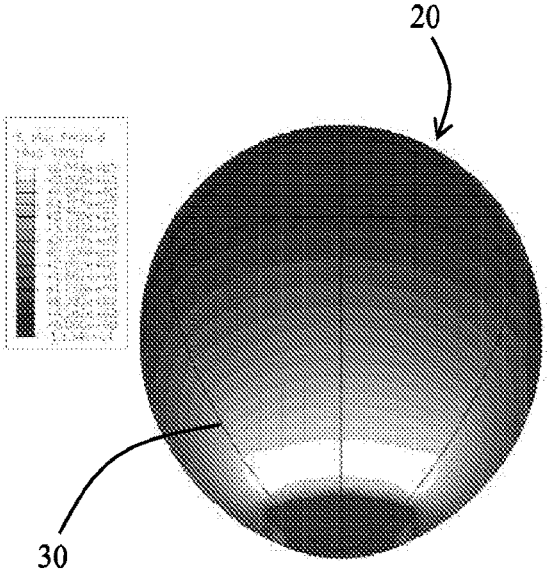
Figure 18A:
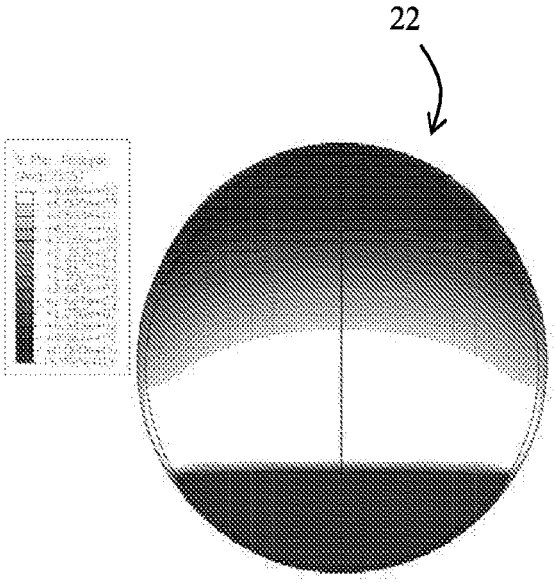
FIGS. 18A-18D show finite element analysis comparing stress accumulation in a cutting element according to embodiments of the present disclosure (FIG. 18D) to stress accumulation in comparison cutting elements (FIGS. 18A-C) under same conditions.
Figure 18B:
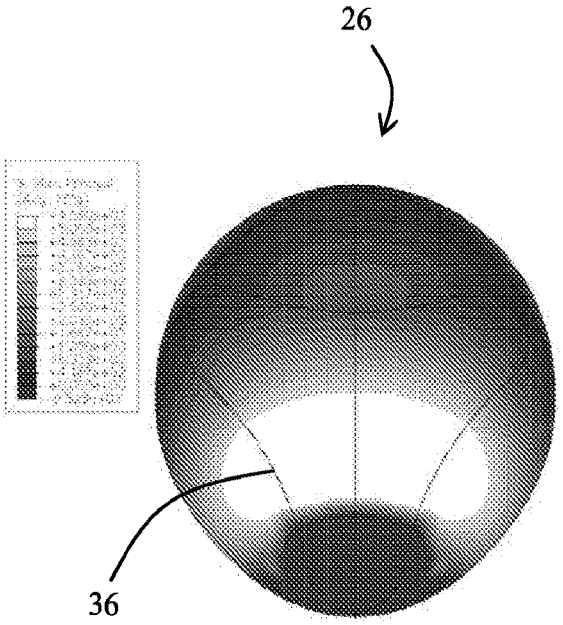
Figure 18C:
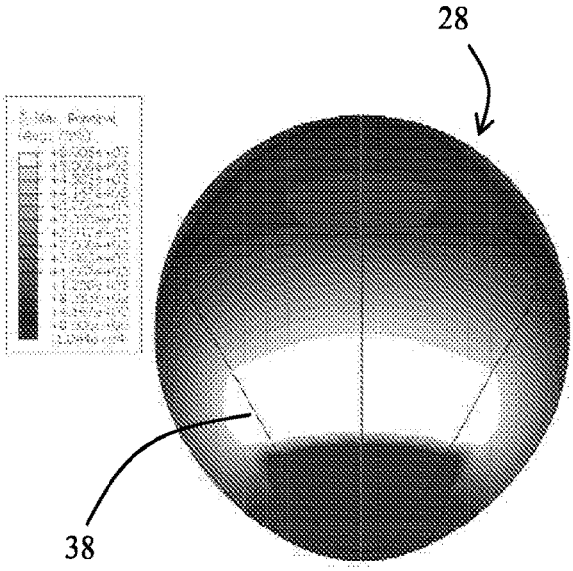
Figure 18D:
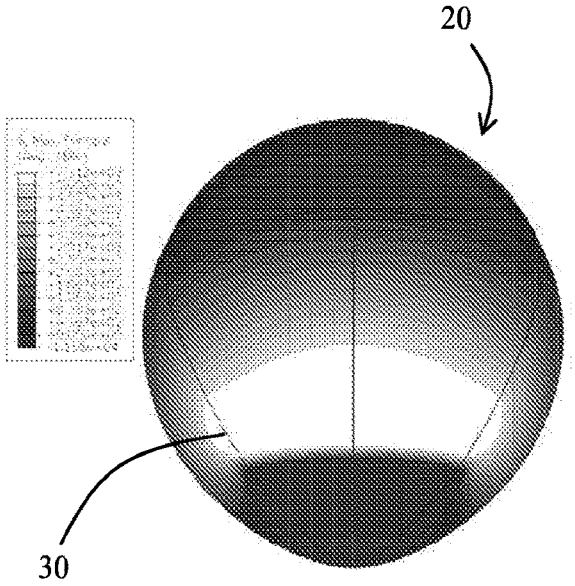

FIG. 15A shows a top view of a cutting element 900 according to embodiments of the present disclosure, and FIG. 15B shows an axial cross-sectional view along plane A of the cutting element 900. The cutting element 900 includes a geometric shape 912 formed at the cutting element cutting face 910, where the top surface 911 of the geometric shape 912 is concave with respect to a plane 904 perpendicular to the longitudinal axis 906 of the cutting element. The geometric shape 912 may have a shape chamfer 924 formed around the boundary 914 of the geometric shape 912, where the shape chamfer 924 extends axially and radially outward from an angled intersection with the vertices 916 of the geometric shape boundary 914 to an angled intersection with an edge chamfer 922. The edge chamfer 922 may extend around the periphery of the cutting face 910, entirely surrounding the shape chamfer 924. Further, the cutting element 900 includes four dual chamfer cutting tips 940 formed at the vertices 916 of the geometric shape 912, where at the dual chamfer cutting tips 940, the edge chamfer 922 may slope axially and radially outward from the intersection with the shape chamfer 924 to the edge 920 of the cutting element, and where the edge 920 is formed at the intersection between the cutting face 910 and the side surface 908 of the cutting element.

According to embodiments of the present disclosure, a cutting element may include a diamond table disposed at a cutting end of its body, where the cutting face is formed on the diamond table at the cutting end. Cutting face geometry on a diamond table may include any cutting face geometry described herein.

The embodiments of FIGS. 2-4 and 8-12 show examples of cutting elements having a diamond table disposed on a substrate, where the cutting face is formed on the diamond table, and the substrate forms the base of the cutting element. For example, as seen in FIG. 4, a diamond table 105 is disposed on a substrate 107 at an interface 109, where the cutting face 110 is formed at the cutting end of the diamond table, and the base is formed by the substrate 107 at an opposite axial end.

A diamond table may be disposed on a substrate, for example, by forming the diamond table on the substrate, infiltrating, brazing, or other means of attachment. For example, a diamond table may be formed on a substrate by positioning diamond powder on a pre-formed substrate or on substrate material and subjecting the diamond powder to high pressure high temperature conditions sufficient for diamond-to-diamond bonding to occur, resulting in a polycrystalline diamond table attached to a substrate. In another example, a diamond table may be brazed to a substrate. Other methods of attaching a diamond table to a substrate may be used to form cutting elements according to embodiments disclosed herein.

A diamond table may be formed of, for example, thermally stable polycrystalline diamond, polycrystalline diamond, diamond composite material, and combinations thereof. Further, cutting elements of the present disclosure may utilize different types of ultrahard material to form the cutting end of the cutting element, either instead of or in addition to diamond. For example, diamond-cermet composite material, cubic boron nitride, or other ultrahard material composites may be used to form a cutting end of a cutting element according to embodiments of the present disclosure.

Substrate material may include, for example, a metal carbide and a metal binder which has been sintered. Suitably, the metal of the metal carbide may be selected from chromium, molybdenum, niobium, tantalum, titanium, tungsten and vanadium and alloys and mixtures thereof. For example, sintered tungsten carbide may be formed by sintering a mixture of stoichiometric tungsten carbide and a metal binder.

The geometry of the cutting face may be formed, for example, by pressing ultrahard material (e.g., diamond powder) into a mold having the negative shape of the cutting face geometry and subjecting the material to high pressure high temperatures and/or infiltrating the ultrahard material (where conditions may depend on the ultrahard material) to form an ultrahard table having a cutting face with geometry described herein. In some embodiments, the geometry of the cutting face may be formed by cutting away material from an ultrahard body (e.g., by laser cutting) to form a geometric shape on the ultrahard material body.

In some embodiments, after a cutting face geometry is formed on an ultrahard material body, the ultrahard material body may be treated to change the composition of at least a portion of the cutting face. For example, a polycrystalline diamond table having a cutting face geometry according to embodiments of the present disclosure may be leached along at least a portion of the cutting face to form thermally stable polycrystalline diamond portions of the cutting face.

By forming a geometric shape on a cutting face, as described herein, cutting elements according to embodiments of the present disclosure may have improved cutting efficiency by up to 20 percent. For example, finite element analysis ("FEA") was used to compare the rock cutting efficiency between cutting elements according to embodiments of the present disclosure having a geometric shape formed on the cutting face and conventional cutting elements having a flat cutting face. From the results of the FEA, it was found that the cutting elements according to embodiments of the present disclosure were about 20 percent more efficient at cutting through limestone than the conventional cutting elements and about 9 percent more efficient at cutting through sandstone than the conventional cutting elements.

Further FEA simulations also showed that the maximum principal stress along the cutting face of cutting elements according to embodiments of the present disclosure may be reduced by about 20 percent when compared with conventional cutting face geometry at a given cutting element back rake angle and depth of cut ("DOC").

For example, FIGS. 16A-16D show FEA results for a dynamic stress analysis comparing the maximum stress levels in a conventional cutting element 22 having a flat cutting face (shown in FIG. 16A), a cutting element 26 having a geometric shape with convex sides 36 with respect to its longitudinal axis formed at the cutting face (shown in FIG. 16B), a cutting element 28 having a geometric shape with straight sides 38 formed at the cutting face (shown in FIG. 16C), and a cutting element 20 according to embodiments of the present disclosure having a geometric shape with concave sides 30 with respect to its longitudinal axis formed at the cutting face (shown in FIG. 16D), where the cutting elements were simulated as operating at a 10 degree back rake angle and a 0.080 inch DOC. The conventional cutting element 22 having a flat cutting face (shown in FIG. 16A) showed a maximum stress level of 5,587 psi; the cutting element 26 having a geometric shape with convex sides formed at the cutting face (shown in FIG. 16B) showed a maximum stress level of 5,535 psi; the cutting element 28 having a geometric shape with straight sides formed at the cutting face (shown in FIG. 16C) showed a maximum stress level of 4,745 psi; and the cutting element 20 according to embodiments of the present disclosure having a geometric shape with concave sides formed at the cutting face (shown in FIG. 16D) showed a maximum stress level of 4,427 psi.

FIGS. 17A-17D show FEA results for a dynamic stress analysis comparing the maximum stress levels in a conventional cutting element 22 having a flat cutting face (shown in FIG. 17A), a cutting element 26 having a geometric shape with convex sides 36 with respect to its longitudinal axis formed at the cutting face (shown in FIG. 17B), a cutting element 28 having a geometric shape with straight sides 38 formed at the cutting face (shown in FIG. 17C), and a cutting element 20 according to embodiments of the present disclosure having a geometric shape with concave sides 30 with respect to its longitudinal axis formed at the cutting face (shown in FIG. 17D), where the cutting elements were simulated as operating at a 20 degree back rake angle and a 0.080 inch DOC. The conventional cutting element 22 having a flat cutting face (shown in FIG. 17A) showed a maximum stress level of 7,527 psi; the cutting element 26 having a geometric shape with convex sides formed at the cutting face (shown in FIG. 17B) showed a maximum stress level of 7,563 psi; the cutting element 28 having a geometric shape with straight sides formed at the cutting face (shown in FIG. 17C) showed a maximum stress level of 6,332 psi; and the cutting element 20 according to embodiments of the present disclosure having a geometric shape with concave sides formed at the cutting face (shown in FIG. 17D) showed a maximum stress level of 6,074 psi.

FIGS. 18A-18D show FEA results for a dynamic stress analysis comparing the maximum stress levels in a conventional cutting element 22 having a flat cutting face (shown in FIG. 18A), a cutting element 26 having a geometric shape with convex sides 36 with respect to its longitudinal axis formed at the cutting face (shown in FIG. 18B), a cutting element 28 having a geometric shape with straight sides 38 formed at the cutting face (shown in FIG. 18C), and a cutting element 20 according to embodiments of the present disclosure having a geometric shape with concave sides 30 with respect to its longitudinal axis formed at the cutting face (shown in FIG. 18D), where the cutting elements were simulated as operating at a 20 degree back rake angle and a 0.160 inch DOC. The conventional cutting element 22 having a flat cutting face (shown in FIG. 18A) showed a maximum stress level of 9,084 psi; the cutting element 26 having a geometric shape with convex sides formed at the cutting face (shown in FIG. 18B) showed a maximum stress level of 9,550 psi; the cutting element 28 having a geometric shape with straight sides formed at the cutting face (shown in FIG. 18C) showed a maximum stress level of 8,005 psi; and the cutting element 20 according to embodiments of the present disclosure having a geometric shape with concave sides formed at the cutting face (shown in FIG. 18D) showed a maximum stress level of 7,112 psi.

By forming a geometric shape on the cutting face of a cutting element with sides that are concave with respect to the cutting element longitudinal axis, unexpected amounts of stress reduction occurred at the cutting face of cutting elements according to embodiments of the present disclosure during stress testing. The graphs in FIGS. 19 and 20 show summary comparisons from the FEA dynamic stress analysis shown in FIGS. 16A-18D.

Figure 19:
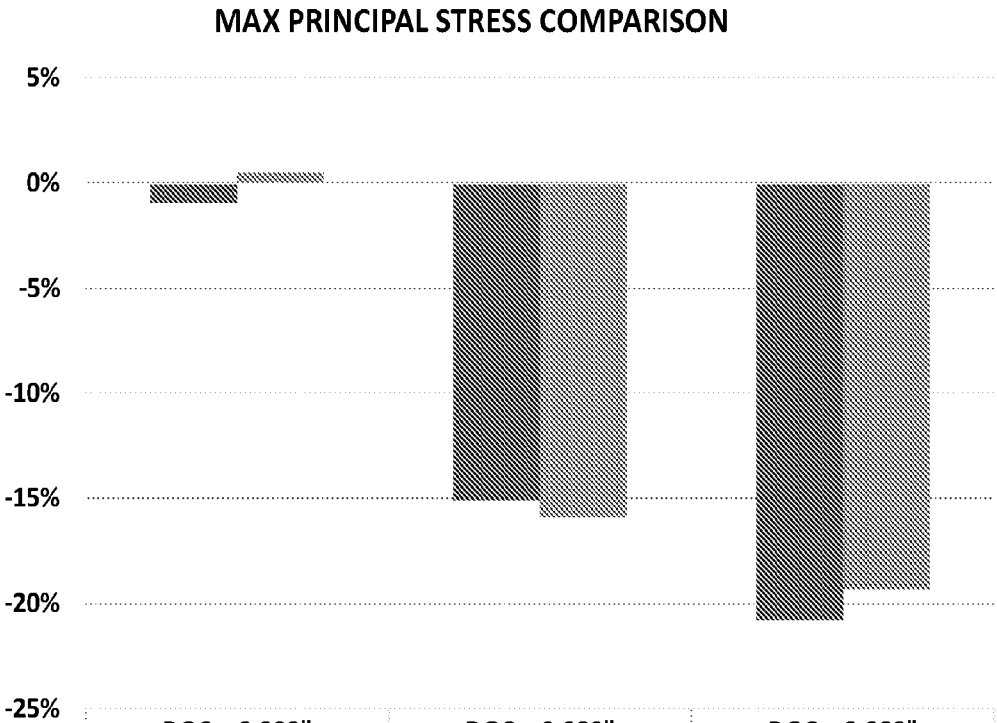
FIG. 19 shows a graph comparing the maximum principal stress from finite element analysis of cutting elements according to embodiments of the present disclosure and comparison cutting elements at different back rake angles.

As shown in FIG. 19, the percentage increase or decrease in maximum principal stress between two types of cutting face geometries at different back rake angles are shown, comparing 1) convex geometric shape cutting faces to flat cutting faces, 2) cutting faces having a geometric shape with straight sides to flat cutting faces, and 3) concave geometric shape cutting faces to flat cutting faces. At the same DOC and back rake angle, cutting elements with a convex geometric shape formed on the cutting face had similar stress levels as conventional cutting elements with a flat cutting face, while cutting elements with a geometric shape having straight sides formed on the cutting face had about 15 percent lower stress, and cutting elements according to embodiments of the present disclosure having a concave geometric shape formed on the cutting face had about 20 percent lower stress.

Figure 20:
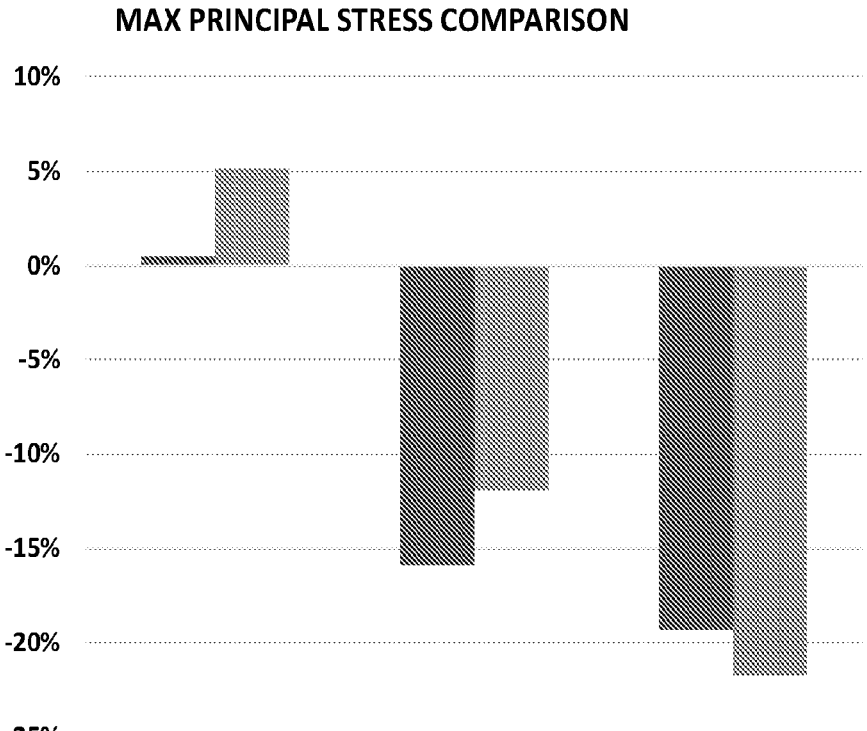
FIG. 20 shows a graph comparing the maximum principal stress from finite element analysis of cutting elements according to embodiments of the present disclosure and comparison cutting elements at different depths of cut.

Referring now to FIG. 20, the percentage increase or decrease in maximum principal stress between two types of cutting face geometries at different DOC are shown, comparing 1) convex geometric shape cutting faces to flat cutting faces, 2) cutting faces having a geometric shape with straight sides to flat cutting faces, and 3) concave geometric shape cutting faces to flat cutting faces. At a higher DOC (0.160"), cutting elements with convex geometric shape cutting faces did not show an advantage over conventional cutting elements with flat cutting faces in terms of stress level. Cutting elements having a geometric shape with straight sides on the cutting face showed a reduced advantage in terms of stress level compared to cutting elements with flat cutting faces at the different DOC, where the difference in stress level shrunk from 16 percent at a DOC of 0.080" to 12 percent at a DOC of 0.160". Cutting elements according to embodiments of the present disclosure having a concave geometric shape formed on the cutting face showed improved stress reduction compared to conventional cutting elements having a flat cutting face, where the stress reduction was further reduced from a 19 percent stress reduction at 0.080" DOC to a 22 percent stress reduction at 0.160" DOC. Thus, FEA analysis shows that cutting elements according to embodiments of the present disclosure may have greater durability at higher DOCs.

Figure 21:
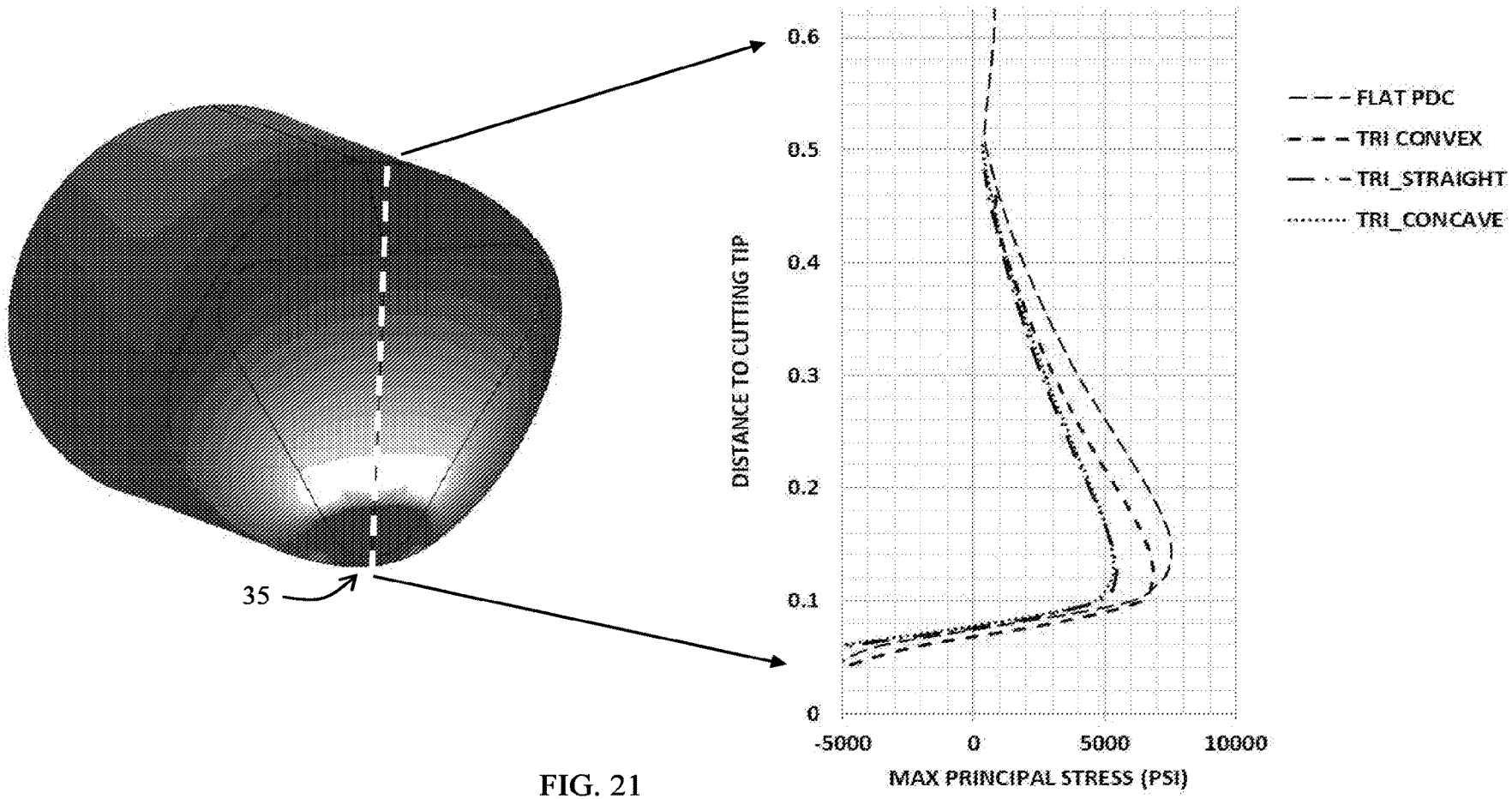
FIG. 21 shows the stress profiles of cutting elements according to embodiments of the present disclosure and comparison cutting elements from finite element analysis.

FIG. 21 shows a stress distribution comparison along a diameter of diamond tables having different cutting face geometries. As shown, the maximum principal stress along the cutting element profiles are highest proximate a simulated operating cutting tip 35 of the cutting element. Cutting elements having a geometric shape with concave sides and cutting elements having a geometric shape with straight sides have about 30 percent lower maximum stress than conventional cutting elements having a flat cutting face.

Figure 22A:
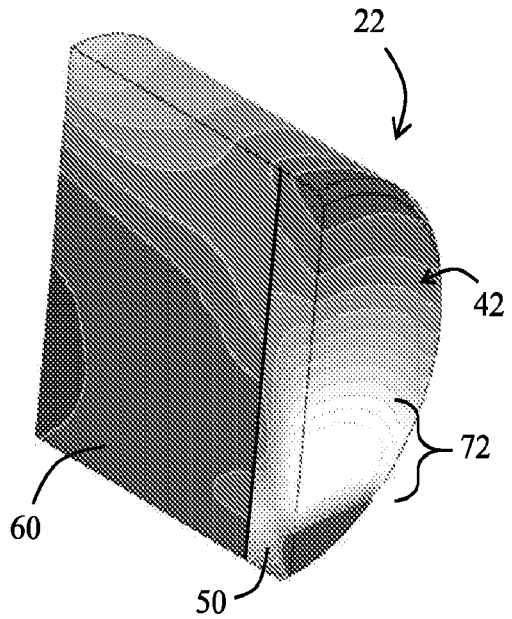
FIGS. 22A-22D show finite element analysis of stress distribution through cutting elements according to embodiments of the present disclosure and comparison cutting elements.
Figure 22B:
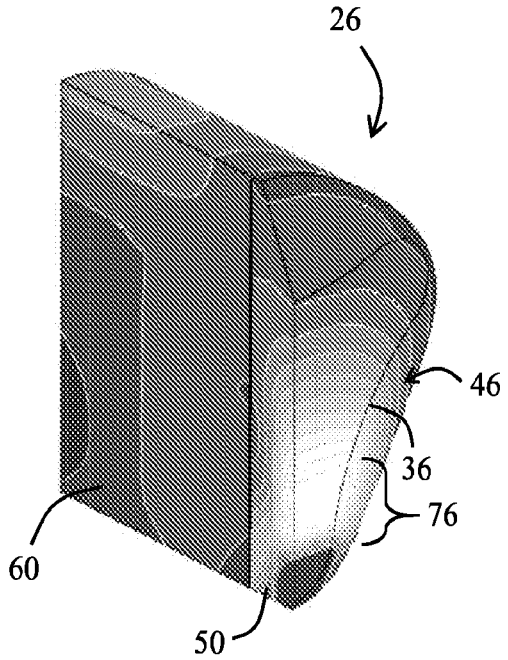
Figure 22C:
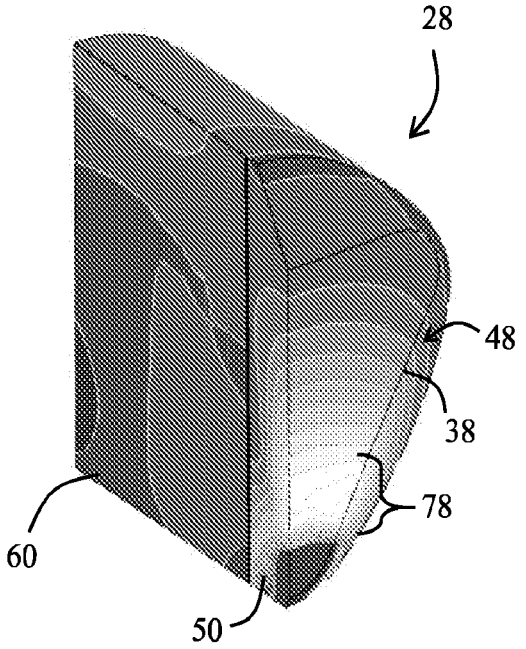
Figure 22D:
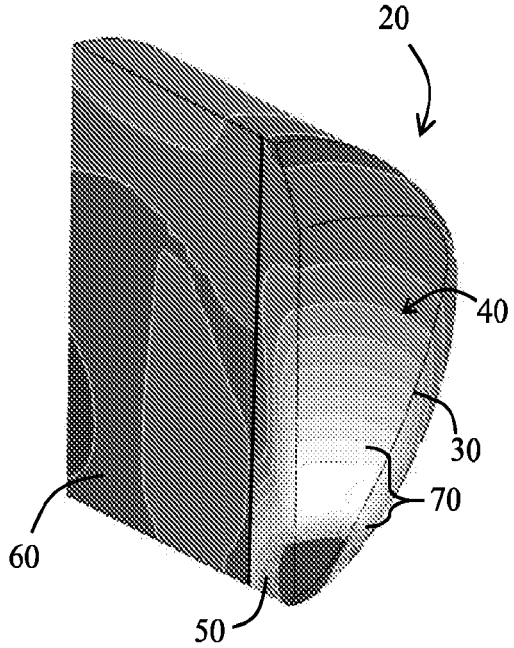

FIGS. 22A-22D show cross sections of perspective views of cutting elements and the stress distribution throughout the cutting element from FEA, where each cutting element has a diamond table 50 mounted to a substrate 60 and a cutting face formed on the diamond table 50. In the FEA, the lighter shading represents higher stress and darker shading represents lower stress. FIG. 22A shows the stress distribution from FEA through a conventional cutting element 22 having a flat cutting face 42. FIG. 22B shows the stress distribution from FEA of a cutting element 26 having a geometric shape with convex sides 36 with respect to its longitudinal axis formed on the cutting face 46. FIG. 22C shows the stress distribution from FEA of a cutting element 28 having a geometric shape with straight sides 38 formed on the cutting face 48. FIG. 22D shows the stress distribution from FEA of a cutting element 20 according to embodiments of the present disclosure having a geometric shape with concave sides 30 formed on the cutting face 40. In each cutting element, the greatest amount of stress (shown in the brackets 72, 76, 78, 70) occurs proximate the cutting tips of each cutting element. Further, a greater amount of stress occurs within the diamond table than the substrate.

From FEA simulating stress profiles through the different types of cutting elements shown in FIGS. 22A-22D, unexpected reduction in stress through the cutting face was found in cutting elements according to embodiments of the present disclosure having a geometric shape with concave sides, as disclosed herein.

Further, it is believed that cutting elements according to embodiments of the present disclosure having a geometric shape with concave sides formed on the cutting face provide equivalent or higher cutting efficiency than conventional cutting elements having a flat cutting face in hard and brittle formations, as well as in soft and ductile formations. It is believed that cutting elements according to embodiments of the present disclosure having a geometric shape with concave sides formed on the cutting face have higher durability than conventional cutting elements having a flat cutting face.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A cutting element comprising:

a body having a base and a cutting face at opposite axial ends and a side surface extending between the base and the cutting face;

an edge formed between the cutting face and the side surface;

an edge chamfer having a uniform size around the entire edge;

a geometric shape formed on the cutting face and defined by a concave boundary with respect to a longitudinal axis of the cutting element, the concave boundary comprising:

multiple rounded vertices, each rounded vertex located proximate to the edge chamfer and forming a cutting tip; and multiple geometric shape sides connecting the rounded vertices, wherein the geometric shape sides are concave with respect to the longitudinal axis; and a shape chamfer formed around the entire concave boundary of the geometric shape.

2. The cutting element of claim 1, wherein the shape chamfer intersects with the edge chamfer at the cutting tips forming dual chamfer cutting tips.

3. The cutting element of claim 1, wherein a planar surface slopes toward the base from each of the geometric shape sides to the edge chamfer.

4. The cutting element of claim 1, wherein the body comprises a diamond table disposed on a substrate, wherein the cutting face is formed on the diamond table, and the substrate forms the base.

5. The cutting element of claim 1, wherein the geometric shape sides have a radius of curvature that is at least 50 percent of an outer diameter of the cutting element.

6. The cutting element of claim 1, wherein the geometric shape comprises a planar top surface extending along a plane perpendicular to the longitudinal axis and forming a portion of the cutting face.

7. The cutting element of claim 1, wherein the geometric shape comprises a convex top surface with respect to a plane perpendicular to the longitudinal axis, wherein the convex top surface forms a portion of the cutting face.

8. The cutting element of claim 1, wherein the geometric shape comprises a concave top surface with respect to a plane perpendicular to the longitudinal axis, wherein the concave top surface forms a portion of the cutting face.

9. The cutting element of claim 1, wherein the edge extends around the cutting face at varying axial heights from the base.

10. The cutting element of claim 1, wherein the geometric shape consists of three rounded vertices.

11. The cutting element of claim 1, wherein the geometric shape comprises four or more rounded vertices.

12. A cutting element comprising:

a body having a cylindrical side surface, a cutting face at an axial end of the body, and an edge formed between the side surface and the cutting face;

a geometric shape formed on the cutting face and defined by a concave boundary with respect to a longitudinal axis of the cutting element; and multiple dual chamfer cutting tips formed on the cutting face at one or more vertices of the geometric shape, wherein each dual chamfer cutting tip comprises:

two chamfers positioned axially adjacent to each other and between the geometric shape and the side surface.

13. The cutting element of claim 12, wherein one of the two chamfers positioned axially adjacent the side surface is an edge chamfer formed around the entire edge of the cutting element.

14. The cutting element of claim 12, wherein one of the two chamfers positioned axially adjacent a top surface of the geometric shape is a shape chamfer formed around the top surface.

15. The cutting element of claim 12, wherein the geometric shape is defined by the dual chamfer cutting tips and multiple geometric shape sides extending between the dual chamfer cutting tips, and wherein the geometric shape sides are concave with respect to a longitudinal axis of the cutting element.

16. The cutting element of claim 12, wherein the body comprises a diamond table mounted to a substrate, and wherein the cutting face is formed on the diamond table.

17. The cutting element of claim 12, wherein the dual chamfer cutting tips are evenly spaced around the edge of the cutting face.

18. A cutting element comprising:

a body having a base and a cutting face at opposite axial ends and a side surface extending between the base and the cutting face;

an edge formed between the cutting face and the side surface;

an edge chamfer having a uniform size around the entire edge; and a geometric shape formed on the cutting face and defined by a concave boundary with respect to a longitudinal axis of the cutting element, the concave boundary comprising:

multiple rounded vertices, each rounded vertex located proximate to the edge chamfer and forming a cutting tip; and multiple geometric shape sides connecting the rounded vertices, wherein the geometric shape sides are concave with respect to the longitudinal axis, and wherein a planar surface slopes toward the base from each of the geometric shape sides to the edge chamfer.

19. The cutting element of claim 18, wherein the body comprises a diamond table disposed on a substrate, wherein the cutting face is formed on the diamond table, and the substrate forms the base.

20. The cutting element of claim 18, wherein the geometric shape sides have a radius of curvature that is at least 50 percent of an outer diameter of the cutting element.

* * * * *